US006237910B1

(12) United States Patent
Kawata

(10) Patent No.: US 6,237,910 B1
(45) Date of Patent: May 29, 2001

(54) SHEET PROCESSING APPARATUS PROVIDED WITH SHEET SENSOR AND IMAGE FORMING APPARATUS

(75) Inventor: Wataru Kawata, Kashiwa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/177,570

(22) Filed: Oct. 23, 1998

(30) Foreign Application Priority Data

Oct. 27, 1997 (JP) ..... 9-311294

(51) Int. Cl.[7] ..... B65H 31/04

(52) U.S. Cl. ..... 271/213; 271/215; 271/217; 271/214

(58) Field of Search ..... 271/3.15, 207, 271/213, 214, 215, 217, 152, 154, 265.01, 265.02, 265.04, 279, 288, 303

(56) References Cited

U.S. PATENT DOCUMENTS 4,189,133 * 2/1980 Arrasmith et al. ..... 271/215
4,390,175 * 6/1983 Takahashi et al. ..... 271/215
4,647,034 * 3/1987 Sawa ..... 271/293
5,621,501 4/1997 Matsuo et al. ..... 355/75

* cited by examiner

*Primary Examiner*—Donald P. Walsh
*Assistant Examiner*—Jonathan R Miller
(74) *Attorney, Agent, or Firm*—Fitzpatrick, Cella, Harper & Scinto

(57) ABSTRACT

A sheet processing apparatus has a sheet stacking tray supported for upward and downward movement, a lifting/lowering unit for lifting and lowering the sheet stacking tray, a first sensor for sensing the uppermost surface position of a batch of sheets on the stacking tray and lowering the stacking tray a prescribed amount through the lifting/lowering unit, and a second sensor for sensing that the batch of sheets on the stacking tray is partly drawn out and lifting the stacking tray through the lifting/lowering means to thereby return the stacking tray to a position proper to discharge sheets.

29 Claims, 18 Drawing Sheets

SHEET PROCESSING APPARATUS PROVIDED WITH SHEET SENSOR AND IMAGE FORMING APPARATUS

BACKGROUND OF THE INVENTION

1. Field of the Invention

The present invention relates to a sheet processing apparatus provided with a sheet sensor, and more specifically, to a sheet processing apparatus provided with, for example, sheet stack means on which discharged sheets are sequentially stacked and to an image forming apparatus provided with the sheet processing apparatus.

2. Related Background Art

A sheet processing apparatus arranged such that the upper surface of sheets stacked on a stack tray is set to a prescribed height at all times is known.

The sheet processing apparatus comprises a discharged sheet tray on which discharged sheets are sequentially stacked, lifting/lowering device for lifting and lowering the discharged sheet tray, an upper surface sensor for sensing the upper surface of the uppermost sheet of the sheets stacked on the discharged sheet tray and a control for controlling the lifting/lowering device based on a result sensed by the upper surface sensor. A light transparent type sensor, for example, is used as the upper surface sensor. The sensor is composed of a light emitting unit and a light receiving unit disposed on the right side and the left side of the sheet discharge tray, respectively, and the optical axis of them travels a predetermined height above the discharged sheet tray in a right and left direction.

Each time a sheet is stacked on the stack tray, the height of the uppermost sheet is increased. When the uppermost sheet reaches the optical axis, the emitted light is blocked by the sheet, that is, the sensor senses the uppermost sheet. The control lowers the stack tray by controlling the lifting/lowering device based on the result sensed by the sensor. A lowering amount of the stack tray at the time is set to an amount necessary to restore the optical axis shaded by the uppermost sheet. The repetition of the above operation effected each time a sheet is discharged onto the stack tray and stacked thereon permits the uppermost sheet of the sheets on the stack tray to be maintained to the prescribed height at all times.

With this operation, since the height from a discharge port from which a sheet is discharged to the uppermost sheet, that is, a falling height of a sheet when it is discharged can be maintained to the prescribed height, sheets can be discharged and stacked well.

However, according to the above prior art, when sheets discharged onto the stack tray are partially drawn out in a batch, the position of the uppermost sheet on the stack tray is lowered and the falling height of a sheet is increased when it is discharged. Thus, there is a possibility that sheets are discharged and stacked badly.

SUMMARY OF THE INVENTION

An object of the present invention is to solve the aforesaid problem, that is, to provide a sheet processing apparatus for preventing sheets from being discharged and stacked badly when sheets on sheet stack means (the stack tray in the above description) are partly drawn out in a batch and an image forming apparatus provided with such a sheet processing apparatus.

In accordance with these objects, there is provided a sheet processing apparatus comprising a sheet stacking tray supported for upward and downward movement, lifting/lowering means for lifting upward and lowering downward the sheet stacking tray, first sensor means for sensing a position of an upper most surface of a batch of sheets on the stacking tray and for moving the stacking tray a prescribed amount by control of the lifting/lowering means and second sensor means for sensing that the batch of sheets on the sheet ray is partially drawn out and for moving the sheet stacking tray by control of the lifting/lowering means to thereby return the sheet stacking tray to a position proper to discharge sheets.

More specifically, the first and second sensors are each a light transparent type sensor having a light emitting unit and a light receiving unit, the light emitting unit and the light receiving unit of the first sensor forming an optical axis which is approximately parallel with a plane on which the batch of sheets is stacked and the light emitting unit and the light receiving unit of the second sensor forming an optical axis which intersects the plane on which the batch of sheets is stacked.

The following operations will be mainly achieved based on the above arrangement.

When the sheets stacked on the sheet stack means are partly drawn out and the position of the upper surface of the uppermost sheet is lowered, the second sensor senses it and the sheet stack means is lifted until the optical axis of the first sensor is blocked by the sheets stacked on the sheet stack means and thereafter lowered until the optical axis of the first sensor is transmitted. With this operation, since the uppermost sheet of the sheets stacked on the sheet stack means can be disposed in the vicinity of the light axis of the first sensor, the dropping height of the sheets when they are discharged can be set properly, whereby sheets can be preperly discharged onto and stacked on the upper surface of the uppermost sheet.

As described above, according to the present invention, when the sheets on the sheet stack means are partly drawn out, defective discharge and defective stacking of sheets can be effectively prevented.

DESCRIPTION OF THE PREFERRED EMBODIMENTS

Embodiments of the present invention will be described below with reference to the drawings.

<EMBODIMENT >

Figure 21:
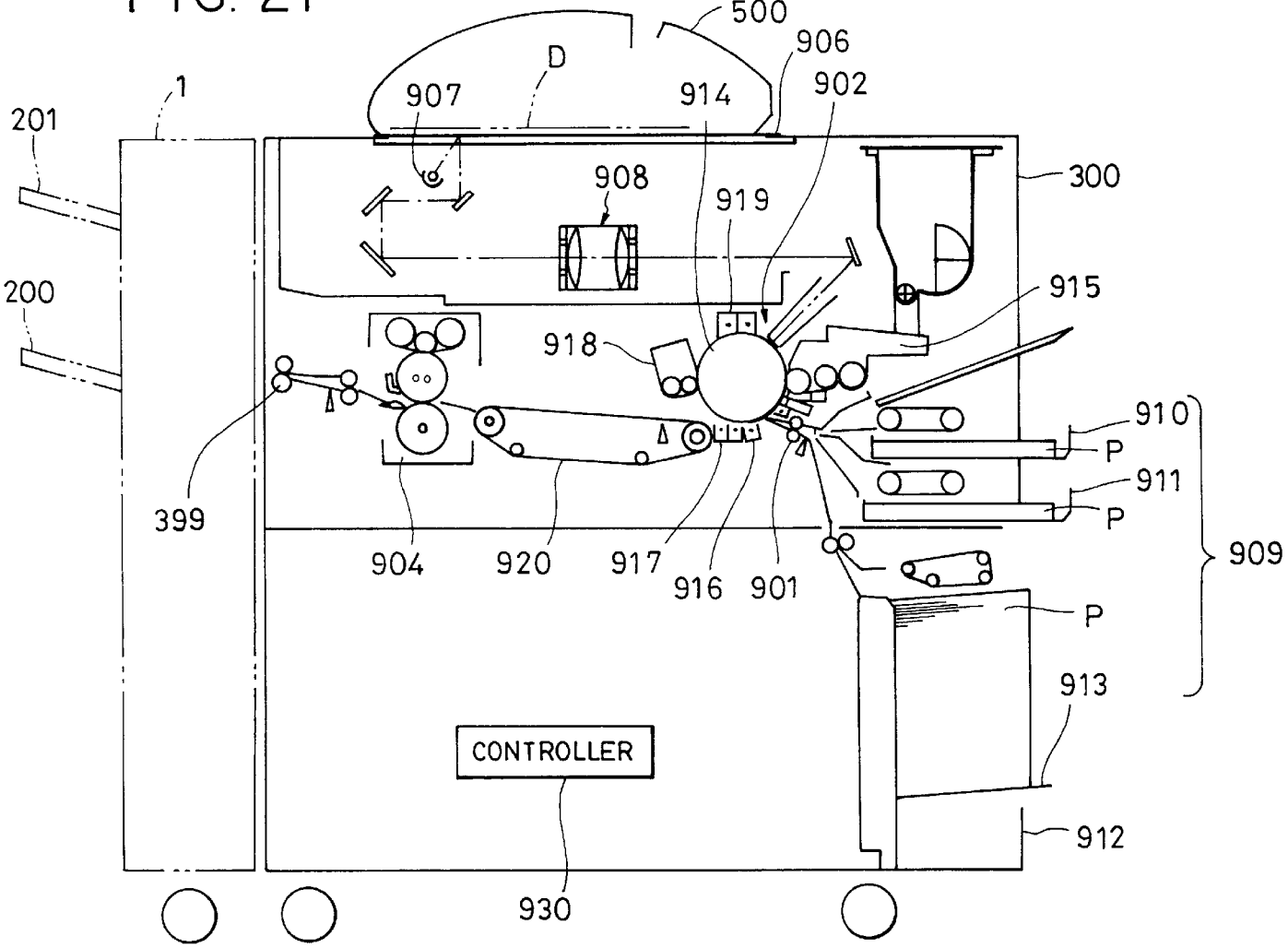
FIG. 21 is a front elevational view of an image forming apparatus to which the sheet processing apparatus according to the present invention is applicable.

FIG. 21 shows an example of a sheet processing apparatus according to the present invention and an image forming apparatus provided with it. The image forming apparatus shown in FIG. 21 is a copier having an automatic document feeder.

The image forming apparatus shown in FIG. 21 comprises an image forming apparatus main body 300, an automatic document feeder 500 and a sheet processing apparatus 1.

The image forming apparatus main body (hereinafter, simply referred to as an apparatus main body) 300 includes a platen glass 906 as an document placing table, a light source 907, a lens system 908, a sheet feed unit 909 and an image forming unit 902. The automatic document feeder (RDF) 500 for feeding a document D onto the platen glass 906, the sheet processing apparatus 1 on which sheets P having an image formed thereon and discharged from the apparatus main body 300 are stacked and the like are mounted on the apparatus main body 300.

The sheet feed unit 909 includes cassettes 910, 911 detachably mounted on the apparatus main body 300 with sheets P such as recording sheets or the like accommodated therein and a deck 913 disposed to a pedestal 912. The image forming unit 902 is provided with a cylindrical photosensitive drum 914 as well as a developer 915, a transfer electrifier 916, a separation electrifier 917, a cleaner 918 and a primary electrifier 919 which are disposed around the photosensitive drum 914. A feed unit 920, a fixing unit 904, and a pair of discharge rollers 399 are disposed downstream of the image forming unit 902. In the figure, numeral 200 denotes a stack tray (to be described later) onto which the sheets P are discharged and numeral 201 denotes a sample tray (to be described later).

Subsequently, an operation of the apparatus main body 300 arranged as described above will be described.

When a sheet feed signal is output from controller (control means) 930 provided within the apparatus main body 300, a sheet P is fed from the cassettes 910, 911 or the deck 913. The light which is incident on the document D placed on the platen glass 906 from the light source 907 and reflected therefrom is irradiated to the surface of the photosensitive drum 914 through the lens system 908. The surface of the photosensitive drum 914 is electrified by the primary electrifier 919 uniformly and thereafter an electrostatic latent image is formed thereon by the irradiation of the light. Next, the electrostatic latent image is developed as a toner image by the toner deposited thereon by the developer 915.

Sheet P from sheet feed unit 909 is fed to the image forming unit 902 while its oblique traveling is corrected and its timing is adjusted by resist rollers 901. At the image forming unit 902, the toner image on the photosensitive drum 914 is transferred onto the thus fed sheet P by the transfer electrifier 916 and the sheet P onto which the toner image is transferred is electrified to a polarity opposite to that of the transfer electrifier 916 by the separation electrifier 917 and separated from the photosensitive drum 914.

The separated sheet P is fed to the fixing unit 904 by the feed unit 920 and the toner image is permanently fixed onto the surface of the sheet P by being heated and pressed in the fixing unit 904. The sheet P on which the toner image is fixed is discharged from the apparatus main body 300 by the pair of discharge rollers 399.

As described above, the sheet P fed from the sheet feed unit 909 is discharged to the sheet processing apparatus 1. The sheet processing apparatus 1 has a sheet puncher 50 (FIG. 1), a stapler unit 100 which will be described later and the like after the image is formed thereon.

Next, a sheet processing apparatus 1 according to the present invention will be described with reference to the drawings.

Figure 1:
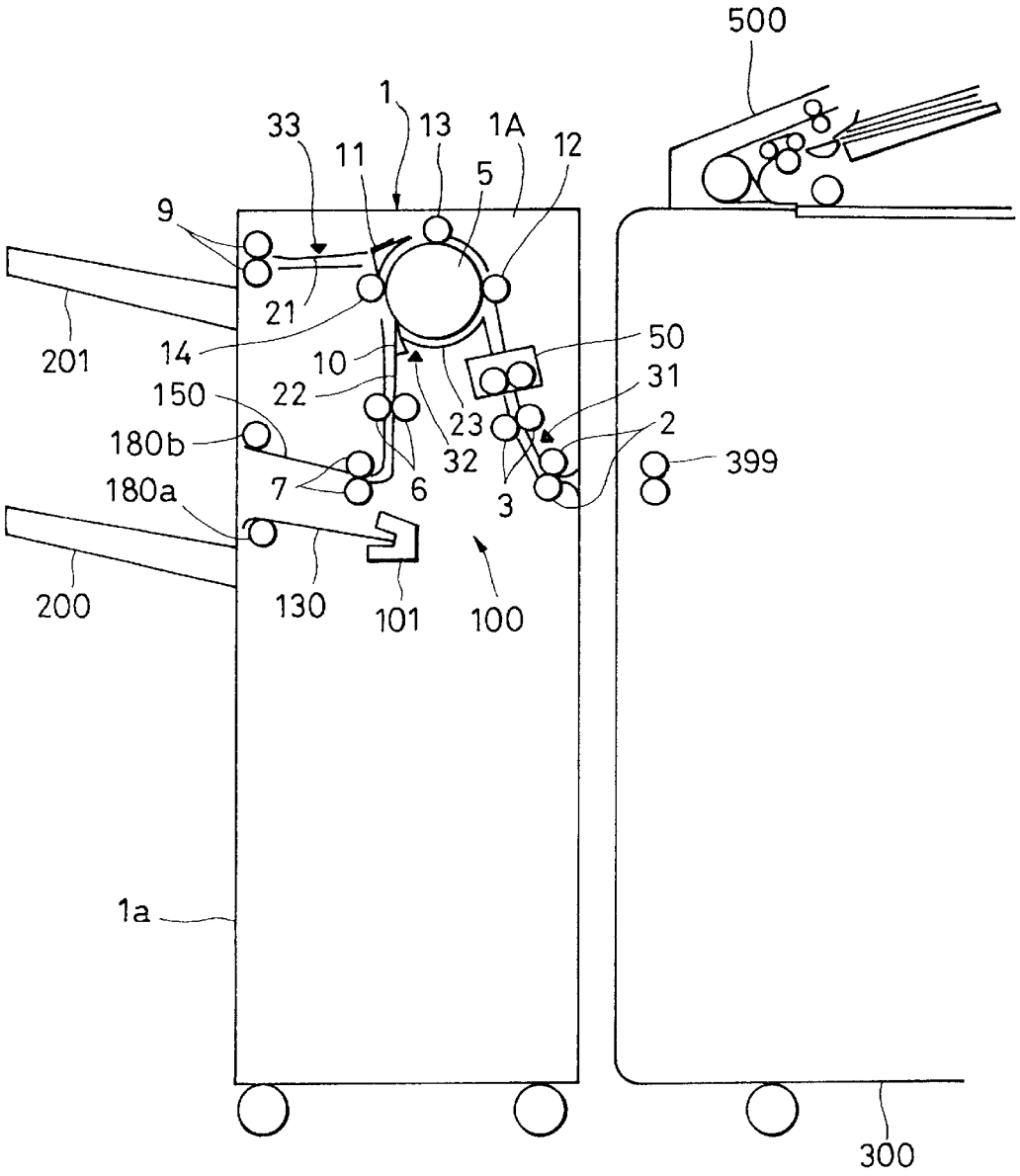
FIG. 1 is a front elevational view showing an entire arrangement of a sheet processing apparatus of the present invention.

In FIG. 1, numeral 1 denotes the sheet processing apparatus (hereinafter, referred to as a "finisher") and numeral 300 denotes an image forming apparatus main body. The detailed description of the image forming apparatus main body 300 and an RDF 500 is omitted here. Numeral 399 denotes a pair of discharge rollers disposed to the image forming apparatus main body 300, numeral 2 denotes inlet rollers disposed to a sheet processing apparatus main body, numeral 3 denotes feed rollers, numeral 31 denotes a sheet sensor, numeral 50 denotes a punch unit (sheet punch unit) for punching holes in the vicinity of the trailing end of a sheet P fed thereto, numeral 5 denotes a large diameter feed roller for feeding the sheet P by pressing it thereagainst with downward press rollers 12, 13, 14.

Numeral 11 denotes a switching flapper for switching a destination of the sheet P between a non-sort path 21 and a sort path 22. Numeral 10 denotes a switching flapper for switching a destination of sheet P between the sort path 22 and a buffer path 23 for temporarily storing the sheet P. Numeral 6 denotes feed rollers 6, numeral 130 denotes a processing tray for temporarily accumulating and aligning sheets P so that they are stapled, numeral 7 denotes discharge rollers for discharging the sheets P onto the processing tray 130, and numeral 150 denotes a swing guide. An upper batch discharge roller 180*b* is supported by the swing guide 150 and feeds, when the swing guide 150 is located at a closed position, the sheets P onto the processing tray 130 in a batch and discharges them onto a stack tray 200 in cooperation with a lower batch discharge roller 180*a* disposed to the processing tray 130.

Figure 2:
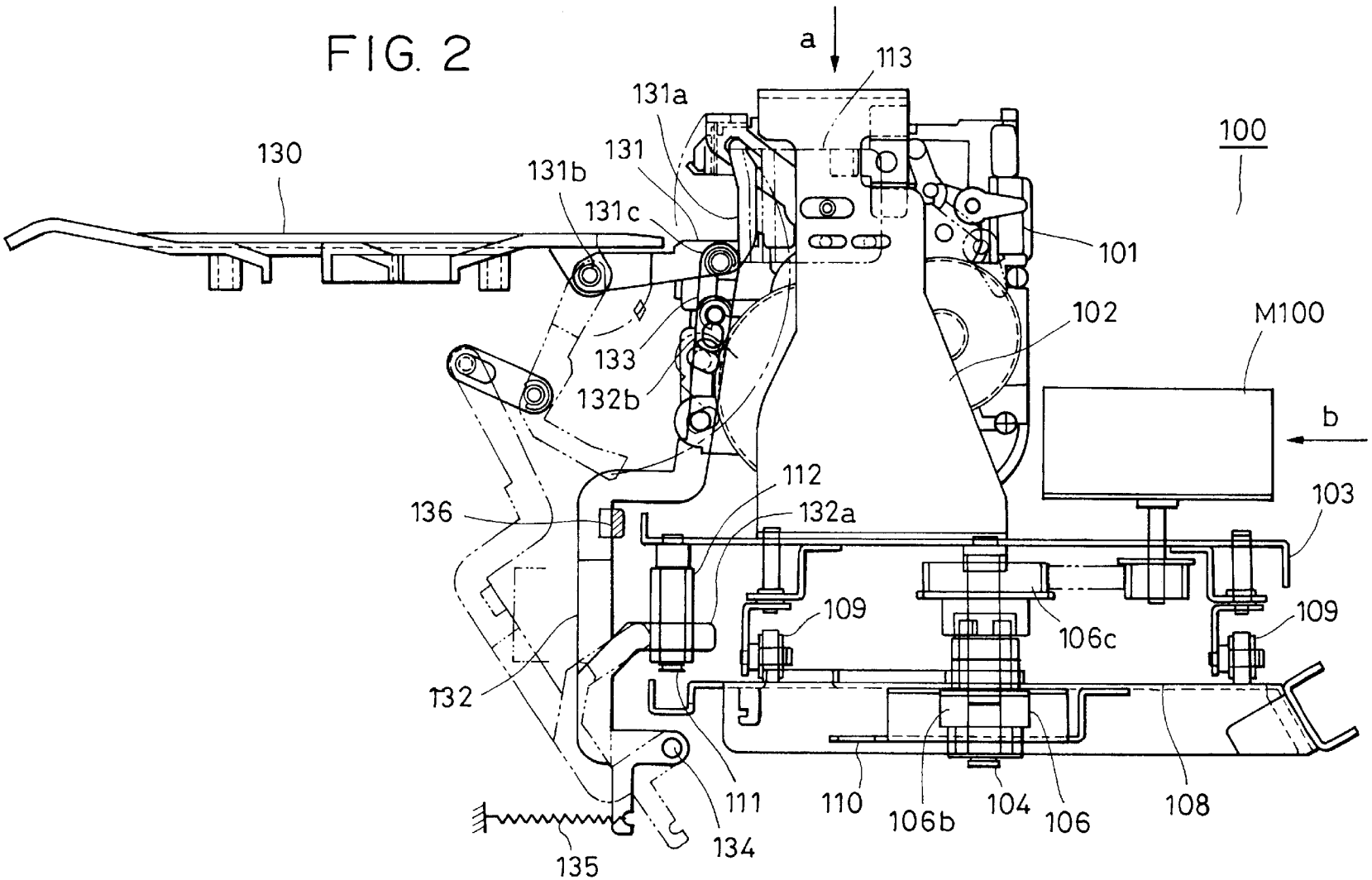
FIG. 2 is a side elevational view of a stapler and a processing tray unit.

Next, the stapler unit 100 will be described with reference to FIG. 2 (main sectional view), FIG. 3 (a fragmental view in the direction of a) and FIG. 4 (a fragmental view in the direction of b).

A stapler 101 which is one of the main components constituting the stapler unit 100 is fixed to a moving table 103 through a holder 102. Rollers 106, 107 are rotatably assembled to shafts 104, 105 fixed to the moving table 103, respectively. These rollers 106, 107 are engaged with hole-shaped recessed rails 108*a*, 108*b*, 108*c* opened to the fixed table 108.

Both the rollers 106, 107 have flanges 106*a*, 107*a* whose diameter is larger than the width of recessed rails of the fixed table 108, whereas supporting rollers 112 are disposed at three positions below the moving table 103. With this arrangement, the moving table 103 which supports the stapler 101 can move on the fixed table 108 along the recessed rails 108*a*, 108*b*, 108*c* without being removed therefrom. The moving table 103 moves on the fixed table 108 through rollers 109 which are rotatably disposed thereto.

Figure 3:
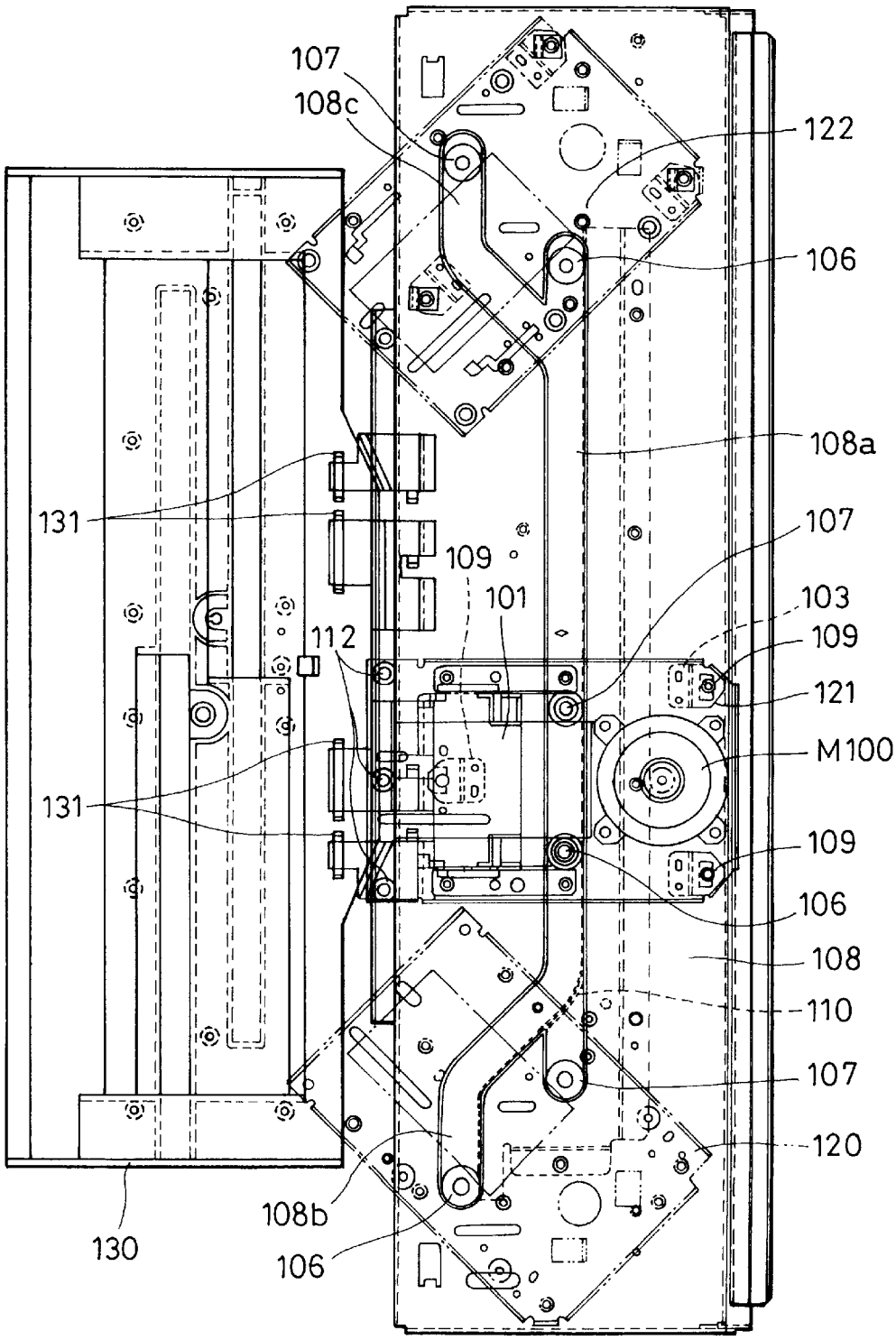
FIG. 3 is a plan view of a stapler moving mechanism from the direction of the arrow a in FIG. 2.
Figure 4:
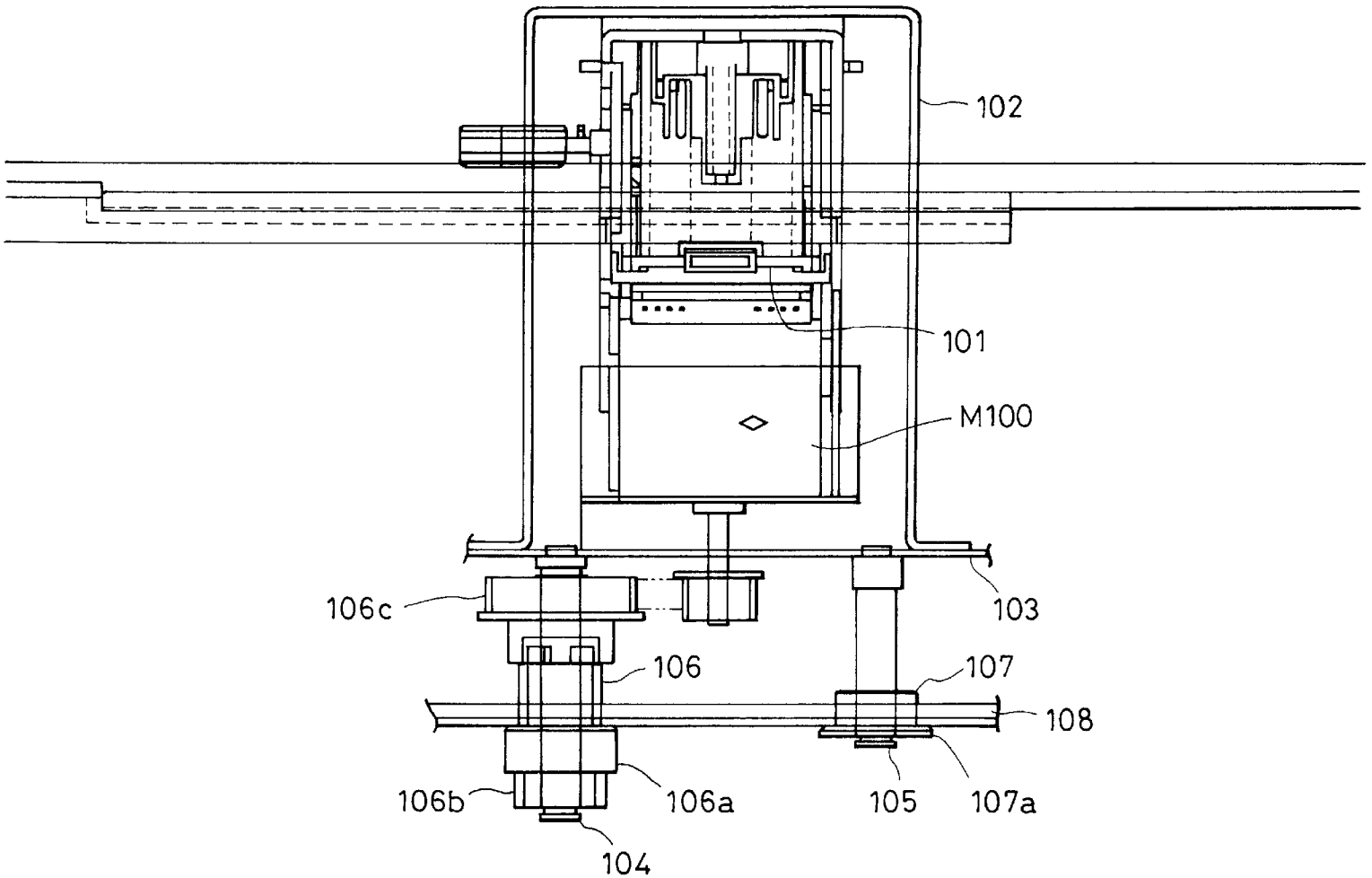
FIG. 4 is a rear elevational view of the stapler from the direction of the arrow b in FIG. 2.

The recessed rails 108*a*, 108*b*, 108*c* are branched to two parallel recessed rails at some midpoints at a forward portion (a lower portion in FIG. 3) and an inside portion (an upper portion in FIG. 3). Such a shape of the recessed rails causes, when the stapler 101 is located forward, that is, on an operator's side, one of the rollers or the roller 106 to be engaged with the recessed rail 108*b* and the other roller 107 to be engaged with the recessed rail 108*b*, respectively so that the stapler 101 is inclined. When the stapler 101 is located at a center, it is held in a horizontal state because both the rollers 106. 107 are engaged with the recessed rail 108*a*.

Further, when the stapler 101 is located inside, one of the rollers or the roller 106 is engaged with the recessed rail 108*a* and the other roller 107 is engaged with the recessed rail 108*c* contrary to the case that the stapler 101 is located on the operator's side so that the stapler 101 is inclined in a direction opposite to that when it is located on the operator's side.

After the two rollers 106, 107 are engaged with the two parallel recessed rails, that is, the recessed rail 108*a* and the recessed rail 108*b* or the recessed rail 108*a* and the recessed rail 108*c*, respectively, the stapler 101 moves while keeping its inclined attitude. Then, the stapler 101 is caused to start to change its direction by a cam (not shown).

Subsequently, a moving mechanism of the stapler 101 will be described.

One of the rollers or the roller 106 of the moving table 103 is composed of a pinion gear 106*b* and a belt pulley 106*c* formed integrally therewith and the pinion gear 106*b* is coupled with a motor M100, which is fixed to the moving table 103 from an upper portion thereof, through a belt trained around the pulley 106*c*. On the other hand, a rack gear 110 is fixed to the lower surface of the fixed table 108 so that it is meshed with the pinion gear 106*b* along the recessed rail 108*a*. As a result, the moving table 103 is moved forward and backward (upward and downward in FIG. 3) together with the stapler 101 by the forward and rearward rotation of the motor M100.

A shaft 111 extending in the lower surface direction of the moving table 103 is provided with a stopper bringing-down roller 112. The stopper bringing-down roller 112 has a role for rotating a trailing end stopper 131 of the processing tray 130, which will be described later, to prevent the trailing end stopper 131 from colliding against the stapler 101. The role of the stopper bringing-down roller 112 will be described later.

The stapler unit 100 includes a sensor for sensing the home position of the stapler 101 and the stapler 101 ordinarily waits at the home position (at the forefront in the embodiment).

Next, the trailing end stopper 131 for supporting the trailing end of sheets P stacked on the processing tray 130 will be described.

The trailing end stopper 131 has a surface vertical to the stacking surface of the processing tray 130 and includes a support surface 131*a* for supporting the trailing end of the sheets, a pin 131*b* engaged with and swung in the round hole defined to the processing tray 130 and a pin 131*c* engaged with a link to be described later. The link is composed of a main link 132 having a cam surface 132*a* pressed by the roller 112 assembled to the stapler moving table 103 and abutted thereagainst and a coupling link 133 for coupling a pin 132*b* disposed to the upper end of the main link 132 with the pin 131*c* of the trailing end stopper 131.

The main link 132 is swung around a shaft 134 serving as a fulcrum B which is fixed to a frame (not shown). In addition, since a pull spring 135 is disposed to the lower end of the main link 132 for urging it clockwise in FIG. 2 and the main link 132 is positioned by an abutting plate 136, the trailing end stopper 131 ordinarily maintains a vertical attitude with respect to the processing tray 130.

When the moving table 103 moves, the bringing-down roller 112 provided with the moving table 103 brings down the cam surface 132*a* of the main link 132 coupled with the trailing end stopper 131 which is in an interference relationship with the stapler 101 so that the trailing end stopper 131 is pulled by the coupling link 133 and rotated up to a position where it is not interfered with the stapler 101. There are provided a plurality of bringing-down rollers 112 (3 sets in the embodiment) to permit the trailing end stopper 131 to maintain the retreated position while the stapler 101 moves.

There are disposed staple stoppers 113 (two-dot-and-dash line) having the same shape as that of the trailing end stopper 131 on both the sides of the holder 102 for supporting the stapler 101. Therefore, even if the stapler 101 is held in a horizontal state (at the center) and presses the trailing end stopper 131, the trailing end of the sheets can be supported by the staple stoppers 113.

Next, a processing tray unit 129 will be described with reference to FIG. 5 and FIG. 6.

The processing tray unit 129 is disposed at a midpoint between feed units 2, 3, 5, 7 for feeding the sheets P from the apparatus main body 300 and a stack tray 200 for receiving and accommodating a batch of sheets processed by the processing tray 130.

The processing tray unit 129 is composed of the processing tray 130, the trailing end stopper 131, alignment means 140, a swing guide 150, a drawing-in paddle (hereinafter, simply referred to as a "paddle") 160, a projecting/retracting tray 170 and a pair of batch discharge rollers 180.

The processing tray 130 is an inclined tray disposing its downstream side (the left side in the figure) upward and its upstream side (the right side in the figure) downward and the aforesaid trailing end stopper 131 is engaged with the lower end of the processing tray 130. A sheet P discharged by the discharge rollers 7 of the feed units slides on the processing tray 130 by its own weight and the action of the paddle 160 to be described later until the trailing end thereof is abutted against the trailing end stopper 131.

The lower batch discharge roller 180*a* is disposed to the upper end of the processing tray 130, the upper batch discharge roller 180*b* which is abutted against the lower batch discharge roller 180*a* is disposed to the swing guide 150 to be described later, respectively, and they can be rotated forward and rearward by being driven by a motor M180.

Next, the alignment means 140 will be described with reference to FIG. 6 as a fragmentary view in the direction of c.

Alignment members (alignment walls) 141, 142 as the alignment means 140 are disposed on the operator's side and on the inside, respectively, and they are independently movable forward and backward. Both the operator's side alignment member 141 and the inside alignment member 142 vertically stand on the processing tray 130 and are composed of support surfaces which are bent vertically from alignment surfaces 141*a*, 142*a* for pressing the side end surfaces of sheets and gear portions which extend forward and backward in parallel with the processing tray 130 and to which rack gears are engraved. The two alignment members 141, 142 are supported by open guides extending in the forward and backward direction of the processing tray 130, respectively and assembled so that alignment surfaces appear to the upper surface of the processing tray 130 and the gear portions appear to the lower surface of the processing tray 130.

Individual pinion gears 143, 144 that are meshed with the respective rack gear portions 141*b*, 142*b* are coupled with motors M141, M142 through pulleys and belts and the aligning members 141, 142 are moved forward and rearward by the forward and rearward rotation of these motors M141, M142. The aligning members 141, 142 are provided with sensors (not shown) for sensing their home positions and ordinarily wait at the home positions sensed by the sensors.

In the embodiment, the home position of the operator's side aligning member 141 is set to the forefront and the home position of the inside aligning member 142 is set to the innermost portion.

Next, the swing guide 150 will be described.

Figure 5:
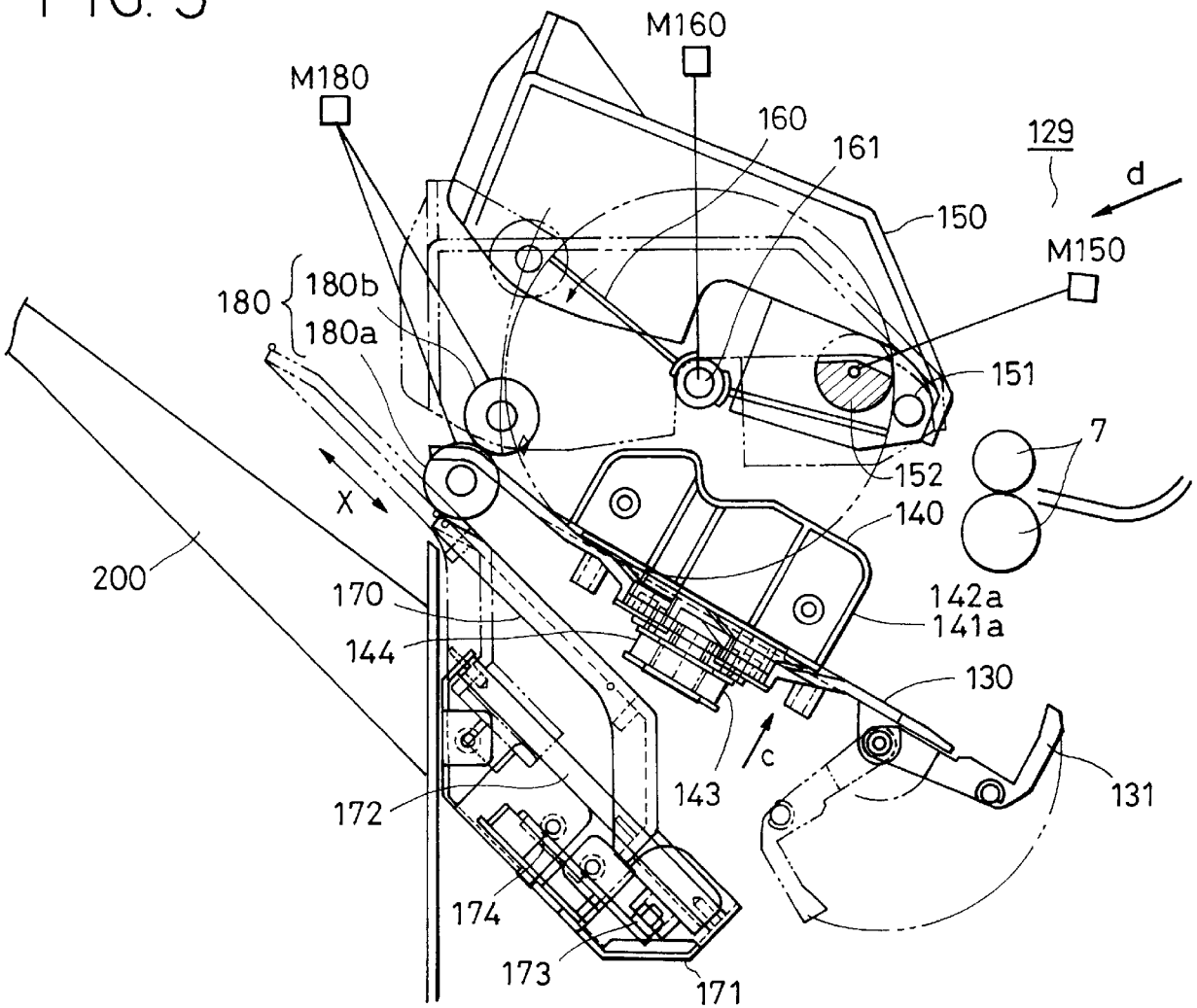
FIG. 5 is a longitudinal side elevational view of a swing guide and a processing tray.
Figure 6:
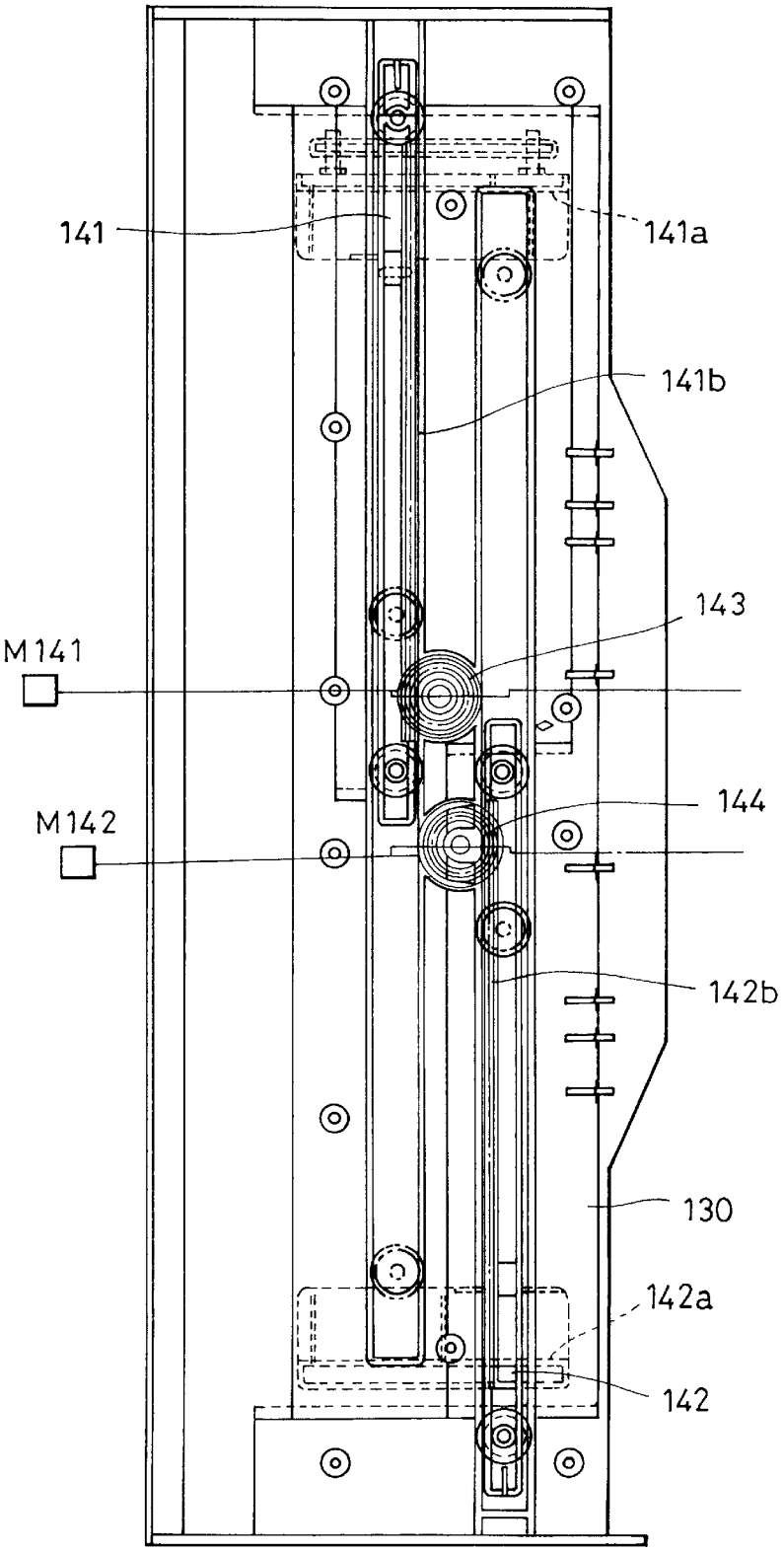
FIG. 6 is a plan view of the processing tray and an alignment wall moving mechanism.

The swing guide 150 supports the upper batch discharge roller 180*b* on a downstream side (on the left side in FIG. 5) and a swing fulcrum shaft 151 is disposed to the swing guide 150 on an upstream side (on the right side in FIG. 5). When the sheets P are discharged onto the processing tray 130 one by one, the swing guide 150 is ordinarily in an open state (the pair of batch discharge rollers 180 are separated from each other) so that it does not interfere when the sheets P are discharged and dropped onto the processing tray 130 and aligned thereon. Whereas, when a batch of sheets is discharged from the processing tray 130 onto the stack tray 200, the swing guide 150 shifts to a closed state (the pair of batch discharge rollers 180 are abutted against each other).

A rotation cam 152 is disposed at a position which corresponds to a side of the swing guide 150. When the side of the guide is moved upward by the rotation of the rotation cam 152, the swing guide 150 is opened while swinging about the shaft 151, whereas when the rotation cam 152 rotates 180° from the above state and separates from the side of the swing guide, the swing guide 150 are closed. The rotation cam 152 is driven in rotation by a motor M150 coupled therewith through a not shown drive system.

Further, the home position of the swing guide 150 is set to the close state and it is provided with a sensor for sensing the close state.

Next, the drawing-in paddle 160 will be described.

The drawing-in paddle 160 is fixed to a paddle shaft 161 which is rotatably supported by front and rear side plates. The paddle shaft 161 is coupled with a motor M160 and when it is driven by the motor M160, it rotates counterclockwise in FIG. 5. The length of the drawing paddle 160 is set slightly longer than the distance to the processing tray 130 from it and the home position of the drawing-in paddle 160 is set to a position (shown by the solid line in the figure) where it is not abutted against the sheets P discharged onto the processing tray 130 by the discharge rollers 7. When the sheets P have been discharged and stacked on the processing tray 130 in this state, the drawing-in paddle 160 is rotated counterclockwise by being driven by the motor M160 and draws in the sheets P until they are abutted against the trailing end stopper 131. Thereafter, the drawing-in paddle 160 waits a prescribed period of time and then stops at the home position for the discharge of the next sheet P.

Figure 7:
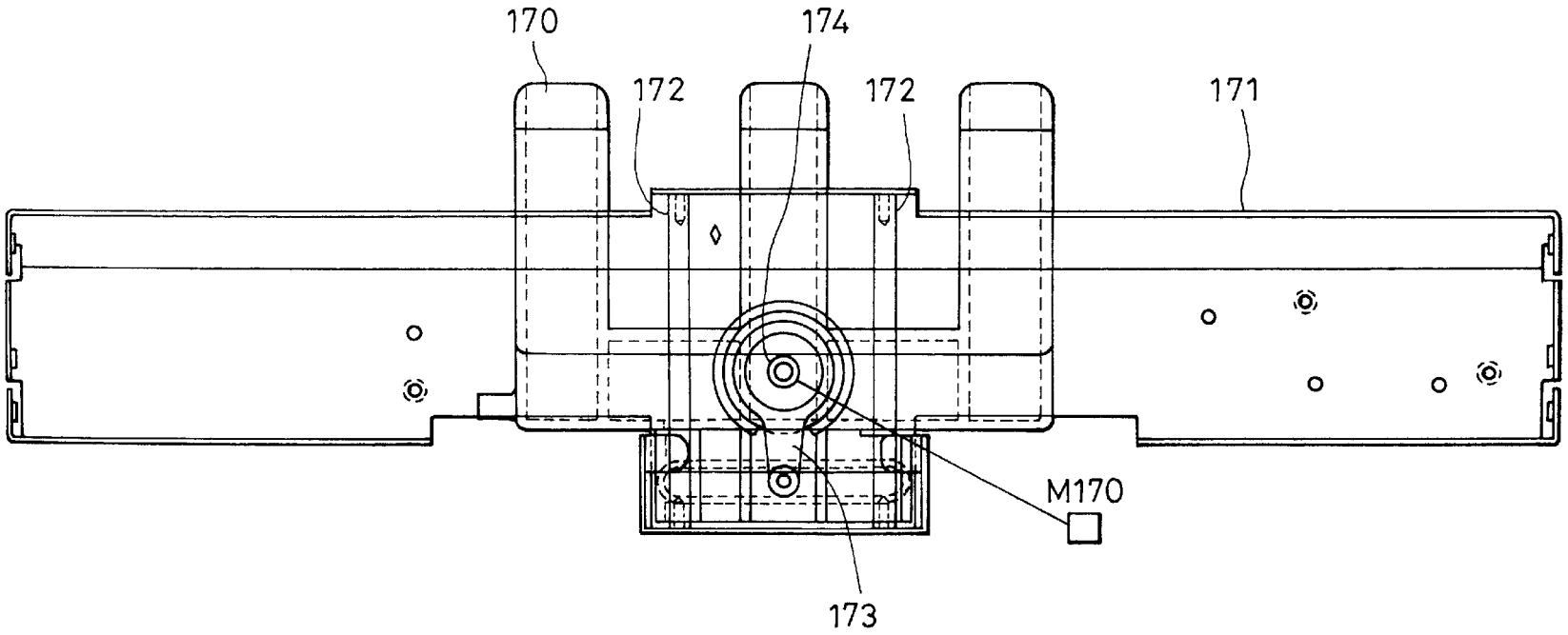
FIG. 7 is a plan view of a projecting/retracting tray.

Next, the projecting/retracting tray 170 will be described with reference to FIG. 5, and to FIG. 7, as a fragmentary view in the direction d shown in FIG. 5.

The projecting/retracting tray 170 is located under the lower batch discharge roller 180*a* and advances and retreats in a sheet feed direction (in the direction shown by the arrow x) approximately along the inclination of the processing tray 130. When the projecting/retracting tray 170 projects, the extreme end thereof overlaps with the stack tray 200 (the two-dot-and-dash-line in FIG. 5), whereas when the projecting/retracting tray 170 retracts, the extreme end thereof retracts to the right side of the pair of batch discharge rollers 180 (the solid line in FIG. 5). The extreme end position of the projecting/retracting tray 170 in the projected state is set such that it is not located beyond the center of gravity of the sheets P discharged onto the processing tray 130.

The projecting/retracting tray 170 is supported by 2 rails 172 fixed to a frame 171 and movable in a sheet discharging direction. Since a rotation link 173 is rotated about a shaft 174 and engaged with a groove formed to the lower surface of the projecting/retracting tray 170, the projecting/retracting tray 170 advances and retracts as described above when the rotation link 173 rotates once.

The rotation link 173 is driven by a motor M170 through a drive mechanism (not shown). The home position of the projecting/retracting tray 170 is set to a retracting position (solid line in FIG. 5) which is sensed by a sensor (not shown).

Next, the stack tray 200 and the sample tray 201 (each serving as sheet stack means) will be described with reference to FIG. 8 and FIG. 9. Note, both the trays are referred to as "trays 200, 201" when they are described together.

These two trays 200, 201 are used separately depending upon a situation; that is, the lower stack tray 200 located is selected when an output from a copier, a printer, and the like are received, whereas the upper sample tray 201 is selected when a sample output, an interrupt output, an output when a stack tray overflows, a function sorting output, an output when jobs are loaded in a mixed state and the like are received.

The trays 200, 201 have motors 202, respectively, so that they can independently travel in an up and down direction.

Motors 202 are mounted on racks 210 which are mounted vertically on frames 250 of a finisher 1 and also act as roller receivers. The trays 200, 201 whose backlash in the operator's side direction and inside direction thereof is regulated by a regulating member 215 is arranged such that a stepping motor 202 is mounted on a tray base plate 211 and a pulley force fitted on a motor shaft transmits the drive force of the stepping motor 202 to a pulley 203 through a timing belt 212.

A shaft 213 coupled with the pulley 203 through a parallel pin transmits the drive force to a ratchet 205 which is also coupled with the shaft 213 through a parallel pin likewise and the ratchet 205 is urged against an idler gear 204 by a spring 206. The idler gear 204 is coupled with a gear 207 to thereby transmit the drive force thereto and the gear 207 is coupled with a gear 209 to thereby transmit the drive force thereto. An additional gear 207 is mounted through a shaft 208 to drive the trays 200, 201 toward the operator's side and the inside and these two gears 207 are coupled with the racks 210 through the gear 209 and an additional gear 209. The trays 200, 201 are fixed by two rollers 214 which are disposed on one side thereof and accommodated in the roller receivers 210 also acting as the racks. Further, the respective trays 200, 201 constitute a tray unit by the motor 202, the idler gear 204, the base plate 211 for supporting them and a sheet support plate (not shown) mounted on the base plate 211 which are arranged integrally each other.

The ratchet 205 slips only in a direction where the trays 200, 201 are lifted by removing the spring 206 to prevent a tray drive system from being damaged by a foreign matter caught by the trays when they are lowered. A sensor S201 senses a slit assembled to the idler gear 204 in order to stop the drive of the motor 202 instantly when the ratchet 205 slips. The sensor S201 is also used to sense a state out of step ordinarily. When the swing guide 150 is located at a close position, it forms a portion the stacking wall of the trays 200, 201 and can move only when a sensor (not shown) senses the close position of the swing guide 150 so that the swing guide 150 can transit upward and downward the opening of the processing tray 130 having a closed portion.

Next, a sensor S202 (FIG. 8) is an areas sensor for sensing the flags of the area from an upper limit sensor S203*a* (see FIG. 9) for stopping the excessive upward movement of the tray 200 to a stack tray sheet surface sensor (lower limit sensor) S203*e*. A sensor 203*b* for sensing the position of a 1000th sheet placed on the sample tray 201 is disposed at a position where the 1000th sheet is placed apart from a non-sort sheet surface sensor (upper surface sensor) S204 to restrict an amount of sheets stacked on the sample tray 201 by height.

Further, a sensor S203*c* is used to restrict the height of a stacked amount when the sample tray 201 receives the sheets P from the sample tray 201 and also disposed at the position where the 1000th sheet is located apart from a sheet sensor S205. A sensor S203*d* is used to restrict a stacked amount when the stack tray 200 receives the sheets P from the processing tray 130 by sensing height and is disposed at a position where a 2000th sheet is located apart from the sheet sensor S205. The sensor S203*e* is the lower limit sensor for preventing the stack tray 200 from being lowered excessively. Among the aforesaid sensors, only the sheet sensors S204, S205 are light transparent type sensors. In addition, the respective trays 200, 201 are provided with sheet presence/absence sensors S206.

A method of sensing a sheet is such that the trays 200, 201 are lifted from under the sheet sensors S204, S205 and when the optical axes of the sensors S204, S205 are blocked by the sheets P stacked on the trays, the trays are lowered until the passages of the optical axes are restored as an initial state and thereafter each time sheets are stacked on the trays 200, 201, they are lowered until the optical axes of the sensors S204, S205 appear and this operation is repeated.

Next, a flow of the sheets P when the user designates a non-sort mode will be described.

Figure 10:
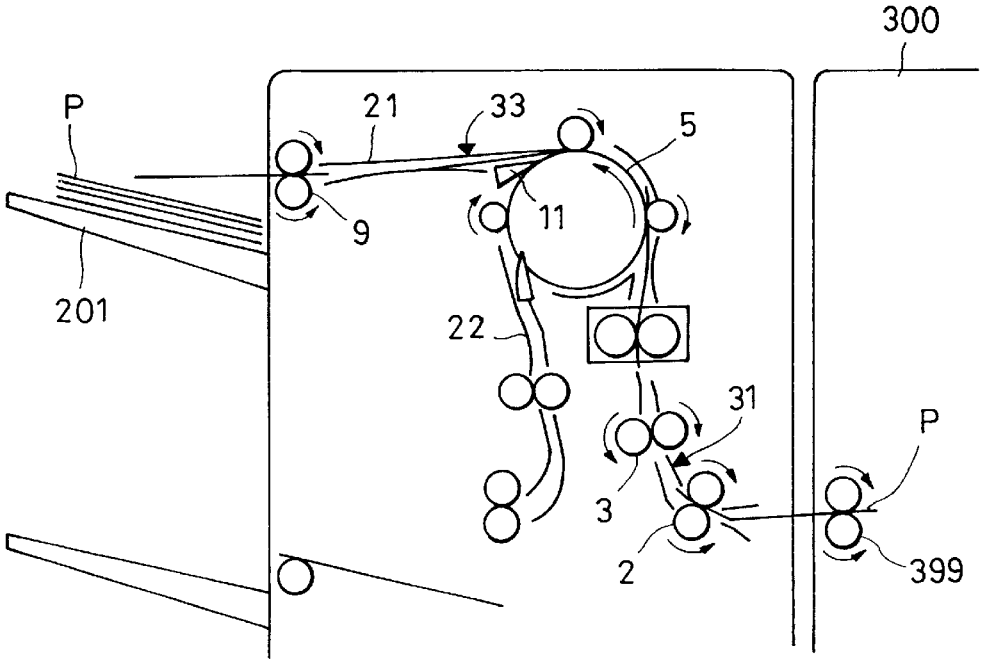
FIG. 10 is a view showing an operation of the sheet processing apparatus in a non-sort mode.

When the user designates the non-sort mode through an operation unit (not shown) of the apparatus main body 300, the inlet rollers 2, the feed rollers 3 and the large diameter feed roller 5 rotate and feed the sheets P fed from the apparatus main body 300 as shown in FIG. 10. The flapper 11 is moved to the position shown in the figure by the action of a solenoid (not shown) and feeds the sheets P to the non-sort path 21. When a sensor 33 senses the trailing end of the sheets P, discharge rollers 9 rotate at a speed suitable for stacking the sheets P and discharge the sheets P onto the sample tray 201.

Next, an operation of sheets P when the user designates a staple sort mode will be described.

Figure 11:
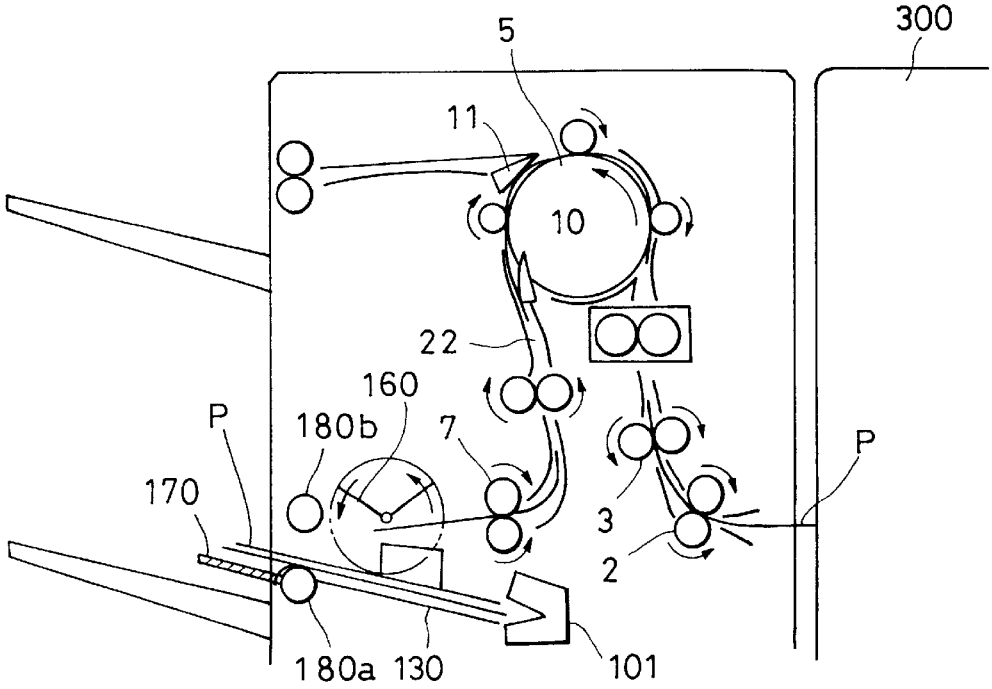
FIG. 11 is a view showing an operation of the sheet processing apparatus in a staple-sort mode.

As shown in FIG. 11, the inlet rollers 2, the feed rollers 3 and the large diameter feed roller 5 rotate and feed the sheets P fed from the apparatus main body 300. The flappers 10, 11 stop at the positions shown in the figure. The sheets P pass through the sort path 22 and are discharged onto the processing tray 130 by the discharge rollers 7. Since the projecting/retracting tray 170 is located at a projecting position at the time, it prevents the falling-down and defective return of the leading edge of the sheets P on the processing tray 130 after they are discharged thereon as well as enhances the alignment of the sheets on the processing tray 130.

The discharged sheets P begin to move to the trailing end stopper 131 by their own weight and further the drawing-in paddle 160 stopped at the home position is rotated counterclockwise by the motor M160 to thereby promote the movement of the sheets P placed on the processing tray 130. When the trailing end of the sheets P is stopped by being reliably abutted against the trailing end stopper 131, the rotation of the drawing-in paddle 160 is stopped and the aligning members 141, 142 align the discharged sheets P. An operation for aligning the sheets P will be described later.

Figure 12:
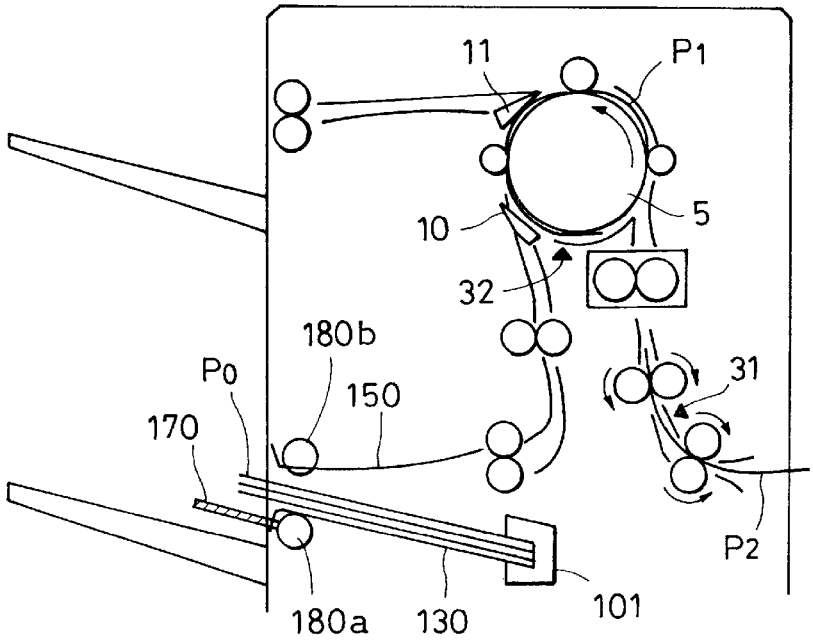
FIG. 12 is a view showing an operation of the sheet processing apparatus in the staple-sort mode.

When a first batch of the sheets P is entirely discharged onto the processing tray 130 and aligned, the swing guide 150 is lowered as shown in FIG. 12 and the upper batch discharge roller 180*b* rides on the batch of sheets and the stapler 101 staples the batch of the sheets.

Figure 13:
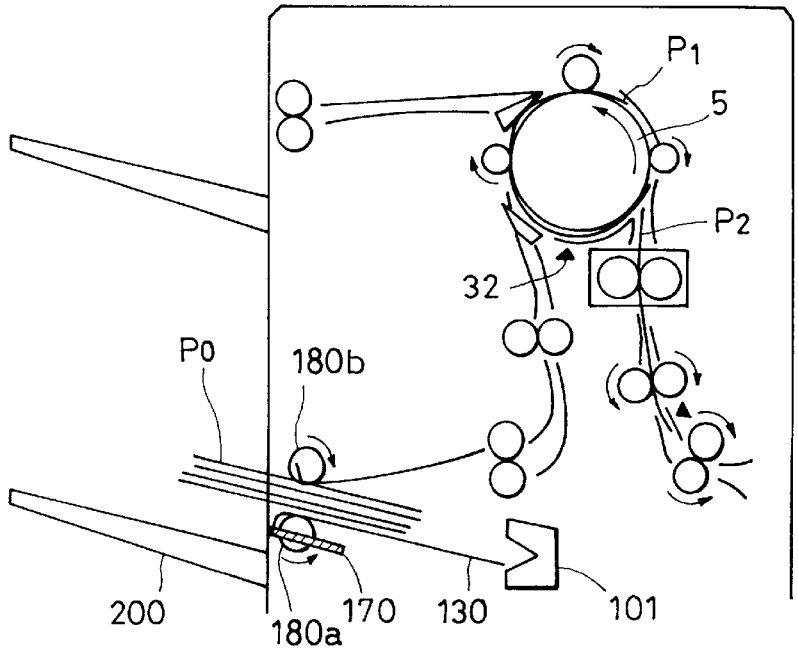
FIG. 13 is a view showing an operation of the sheet processing apparatus in the staple-sort mode.
Figure 14:
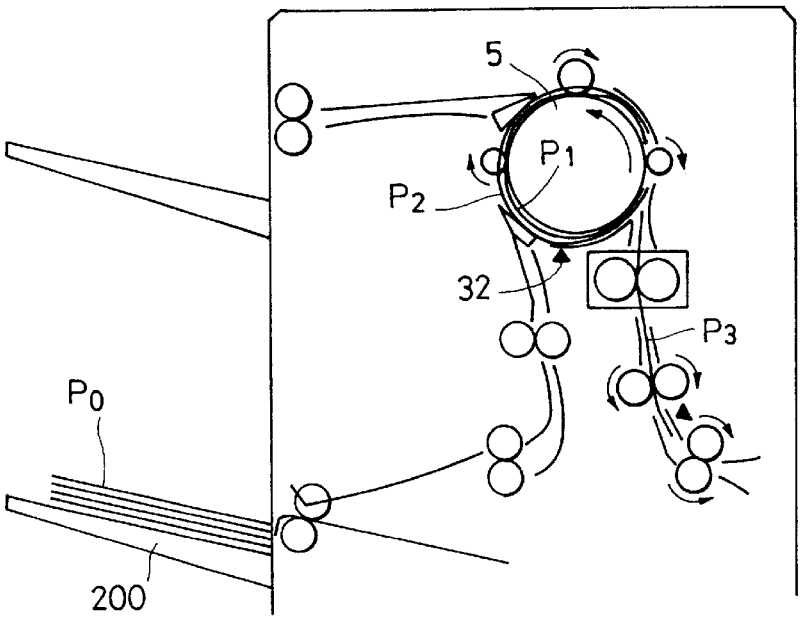
FIG. 14 is a view showing an operation of the sheet processing apparatus in the staple-sort mode.
Figure 15:
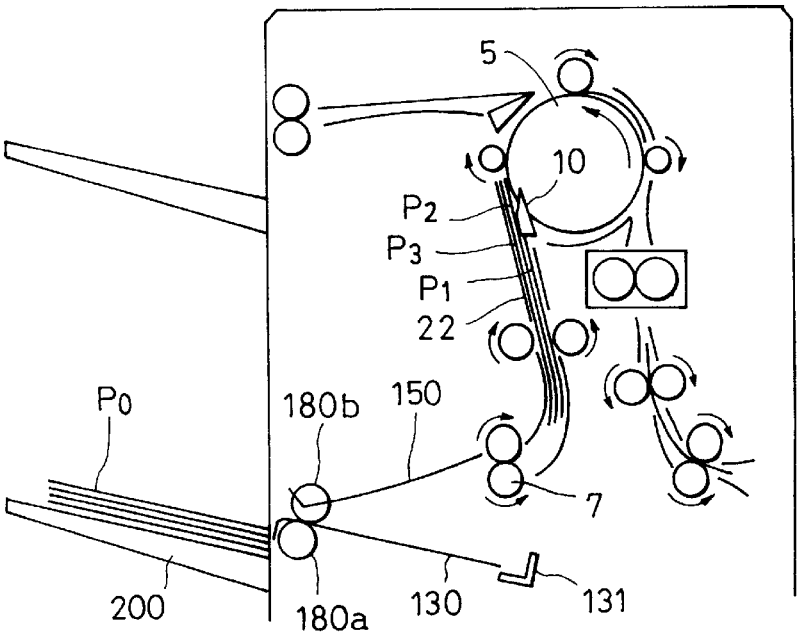
FIG. 15 is a view showing an operation of the sheet processing apparatus in the staple-sort mode.

During the above operation, a sheet $P_1$ discharged from the apparatus main body 300 is wound around the large diameter feed roller 5 by switching the switching flapper 10 as shown in FIG. 12 and stops at a position apart from the sheet sensor 31 a prescribed distance. When a next sheet $P_2$ advances a prescribed distance from the sheet sensor 31, the large diameter feed roller 5 rotates and overlaps the second sheet $P_2$ and the first sheet $P_1$ so that the second sheet $P_2$ advances a prescribed distance with respect to the first sheet $P_1$ as shown in FIG. 13, they are wound around the large diameter feed roller 5 as shown in FIG. 14 and stop after they travel a prescribed distance. On the other hand, the batch of sheets on the processing tray 130 is discharged onto the stack tray 200 in the batch as shown in FIG. 14.

At the time, however, the projecting/retracting tray 170 moves to the home position before the batch of sheets leaves the pair of batch discharge rollers 180 in order to drop the batch of sheets onto the stack tray 200. As shown in FIG. 14, when a third sheet $P_3$ reaches a prescribed position, the large diameter feed roller 5 rotates and overlaps the sheet $P_3$ and the first and second $P_1$, $P_2$ by displacing it therefrom a prescribed distance. Then, the flapper 10 is switched to feed all three sheets P to the sort path 22.

Figure 16:
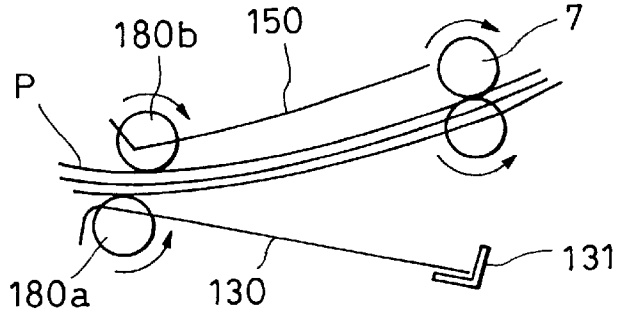
FIG. 16 is a view showing an operation of the sheet processing apparatus in the staple-sort mode.
Figure 17:
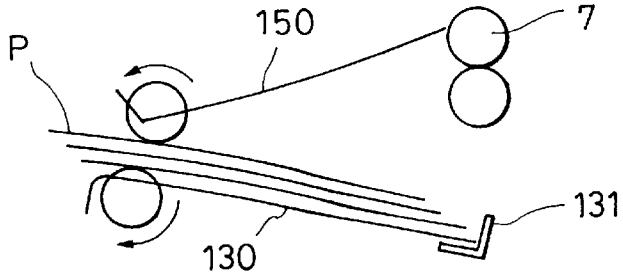
FIG. 17 is a view showing an operation of the sheet processing apparatus in the staple-sort mode.
Figure 18A:
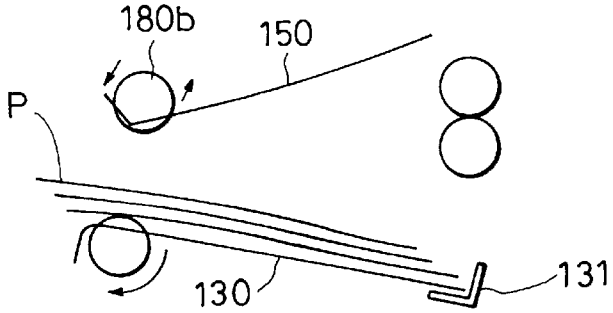
FIG. 18A and FIG. 18B are views showing an operation of the sheet processing apparatus in the staple-sort mode.

As shown in FIG. 16, the three sheets P are received by the lower batch discharge roller 180*a* and the upper batch discharge roller 180*b* in a state that the swing guide 150 is lowered. Rollers 180*a*, 180*b* are reversed when the trailing end of the sheets P leaves the discharge rollers 7 as shown in FIG. 17, and the swing guide 150 is lifted before the trailing end of the sheets P is abutted against the trailing end stopper 131 as shown in FIG. 18A and the upper batch discharge roller 180*b* leaves a sheet surface. The forth and subsequent sheets P pass through the sort path 22 likewise the operation of the first batch of sheets and are discharged onto the processing tray 130. A third and subsequent batches execute the same operation as the second batch and when a set number of batches of sheets are stacked on the stack tray 200, the non-sort mode operation is finished.

Figure 18B:
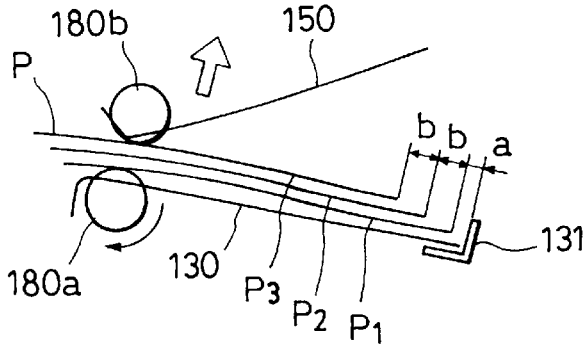

When the plurality of sheets P (sheets $P_1$, $P_2$, $P_3$) are fed in the overlapped state, the respective sheets P are offset in a feed direction. That is, the sheet $P_2$ is offset downward by b with respect to the sheet $P_1$ (see FIG. 18B) and further the sheet $P_3$ is offset downward by b with respect to the sheet $P_2$.

The amount of offset of the sheets P and a timing at which the swing guide 150 is lifted depend on a stationary time (a period of time from a time when a sheet trailing end leaves the rollers 7 to a time when it reaches the trailing end aligning means) which is determined by a return speed of the upper batch discharge roller 180*b*. In the embodiment, when a sheet feed speed is 750 mm/sec, an amount of offset is about (b=20 mm) and a return speed of the batch discharge roller is 500 mm/sec, the timing at which the upper batch discharge roller 180*b* is left is set to a timing when the trailing end of the sheet $P_1$ is located at a position within 40 mm (value a) from the trailing end stopper 131.

Next, a sort mode will be described.

Figure 19:
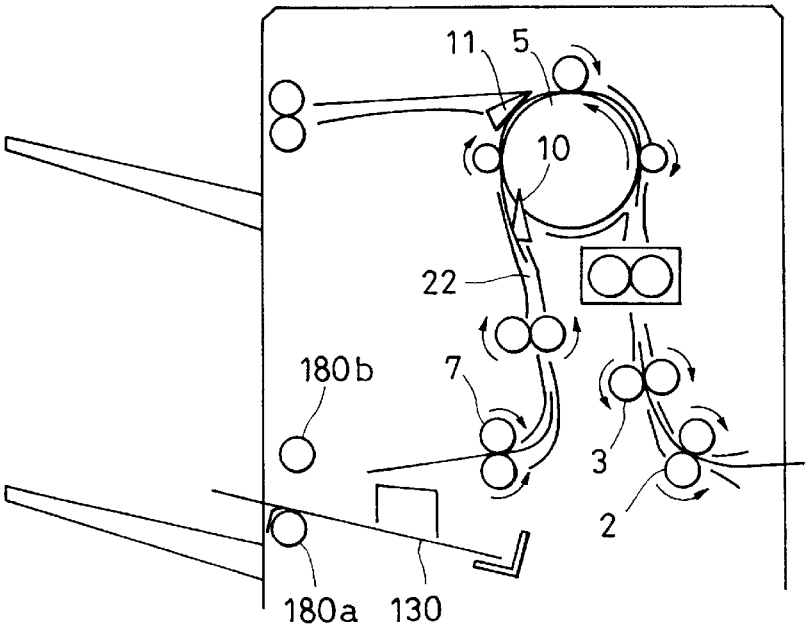
FIG. 19 is a view showing an operation of the sheet processing apparatus in a sort mode.
Figure 20:
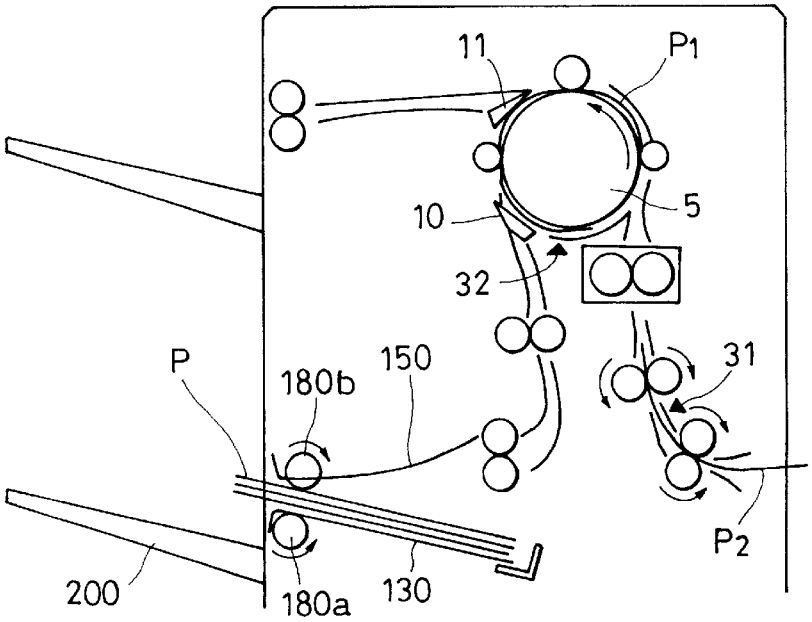
FIG. 20 is a view showing an operation of the sheet processing apparatus in the sort mode.

The user sets the document D on the RDF 500, designates the sort mode through the operation unit (not shown) and turns on a start key (not shown). The inlet rollers 2 and the feed rollers 3 rotate as shown in FIG. 19 to thereby stack the sheets P onto the processing tray 130. After the alignment means 140 stacks a small number of sheets P on the processing tray 130 while aligning the sheets P on the processing tray 130, the swing guide 150 is lowered and feeds a batch of the small number of sheets as shown in FIG. 20.

Next, the thus fed sheets P pass flapper 10 and are wound around the large diameter feed roller 5 by an operation similar to that executed in the aforesaid staple sort mode and discharged onto the processing tray 130 from which the batch of sheets has been discharged. An experiment shows that 20 sheets or less are preferably discharged as the batch of sheets. The number of sheets is set to satisfy the following formula.

number of documents>number of sheets to be discharged in a batch<20 sheets

Therefore, when a number of sheets to be discharged is set to 5 sheets when a program is created and 4 documents are set, each 4 sheets are discharged in a batch. When the number of documents is 5 sheets or more, for example, 14 sheets, they are divided into 5 sheets+5 sheets+4 sheets and then aligned and discharged in a batch, respectively.

When a first batch of sheets is entirely discharged, the operator's side alignment member 141 is moved together with the inside alignment member 142 and they offset a position where a second batch of sheets is aligned with respect to a position where the first batch of sheets is aligned.

The second batch of sheets is aligned at an offset position and each small number of sheets are discharged in a batch as with the first batch. On the completion of the discharge of the second batch, the operator's side aligning member 141 and the inside aligning member 142 return to the positions where they aligned the first batch and align a third batch. As described above, the batches are discharged onto the stack tray 200 while being displaced in a right direction and a left direction with respect to a feed direction and all the set numbers of batches are discharged.

Figure 8:
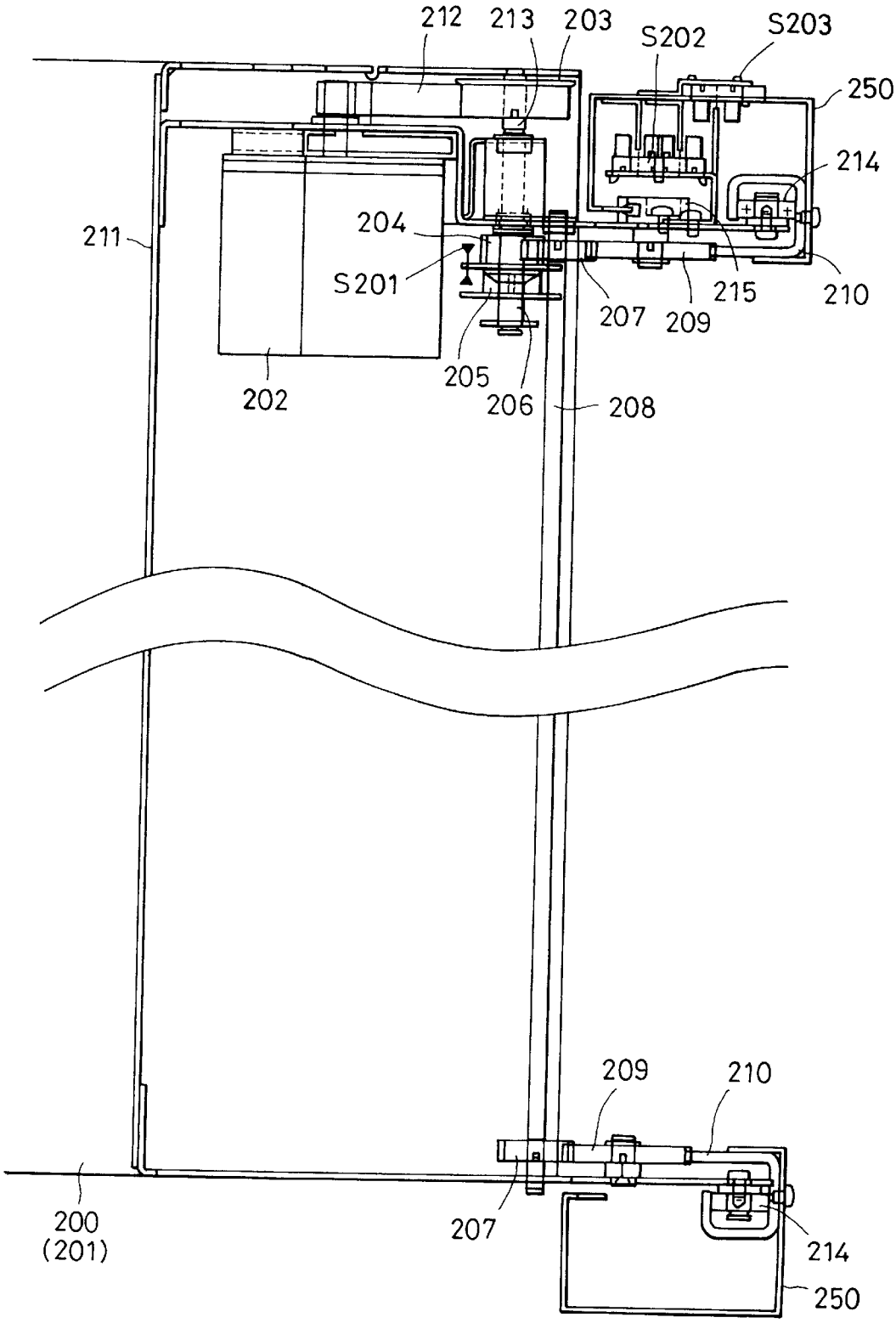
FIG. 8 is a plan view of a stack tray moving mechanism.
Figure 9:
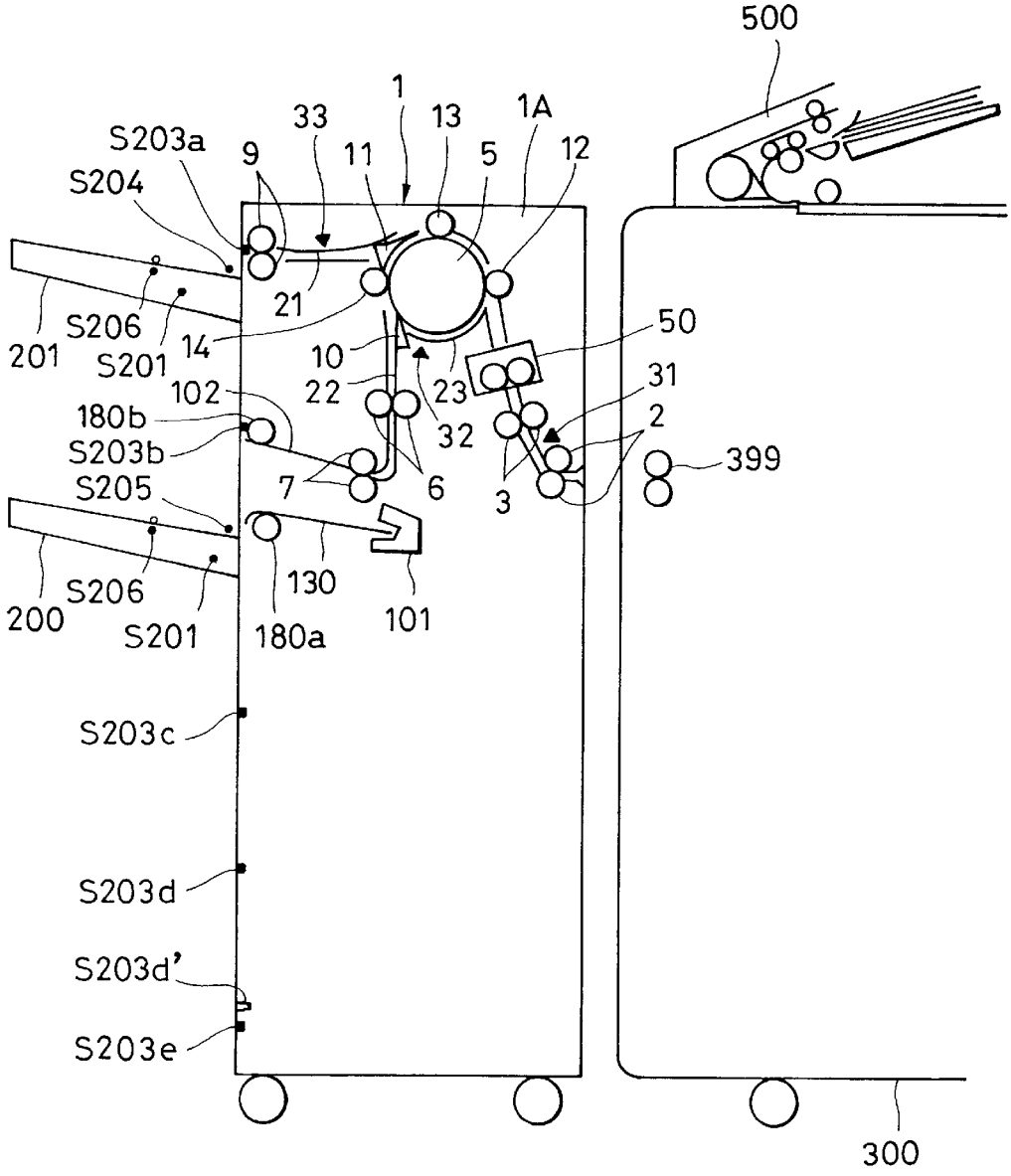
FIG. 9 is a view showing how sensors are disposed around a stack tray.

Next, how the stack tray 200 and the sample tray 201 operate will be described (FIG. 8, FIG. 9). The respective trays 200, 201 wait at the positions of the respective sheet sensors before they start operation.

As described above, the stack tray 200 ordinarily stacks outputs from the copier or the printer, can receive sheets processed by the aforesaid stapler 101 or the like and batches of sheets which are not stapled and discharged in a small number of sheets and stacks up to 2000 sheets and the sensor 203*d* senses the stacked sheets.

At the time, when the outputs from the copier or the printer still continue, the stack tray 200 is further lowered from the position of the sensor S203*d* by an amount corresponding to 1000 sheets (to the position of a sensor S2031'). Subsequently, the sample tray 201 is lowered up to the sheet sensor S205 of the stack tray 200 and begins to receive the sheets P again. At the time, the sample tray 201 can stack up to a maximum of 1000 sheets which are sensed by the sensor S203*c*.

When a next job is started after the completion of a job corresponding to 2000 sheets or less without removing the sheets P on the stack tray 200 or when a present job is interrupted, the sheets P can be stacked on the sample tray 201 from the non-sort path 21 although they cannot be processed.

A mode for outputting the sheets P onto the sample tray 201 using the non-sort path 21 in an ordinary state is used when a portion of the sheets P is output as a sample without being processed or when an output to the sample tray is set in a function sort.

Next, characteristic portions of the present invention will be described in detail with reference to FIG. 22 and FIG. 23. The present invention is arranged such that when the sheets P on the stack tray 200 are partly drawn out, the stack tray 200 is lifted so that the uppermost sheet P is located at an optimum position.

Figure 22:
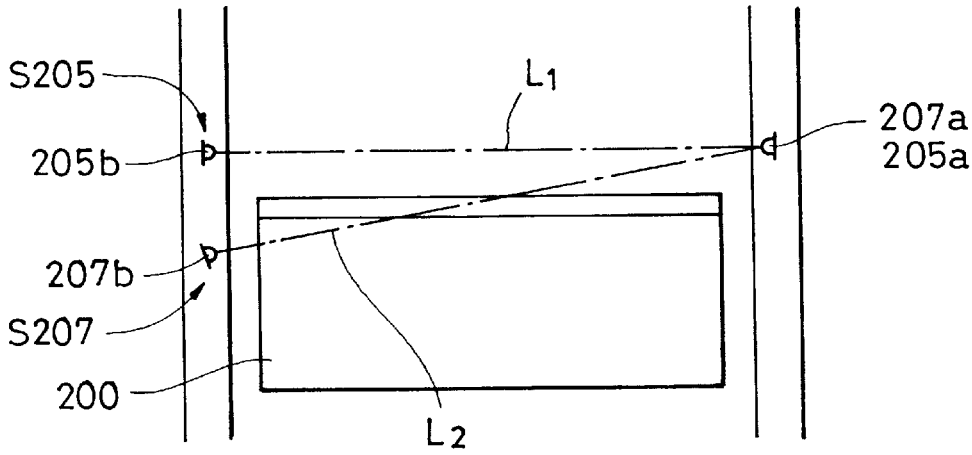
FIG. 22 is a side elevational view of a sheet sensor and the stack tray.
Figure 23:
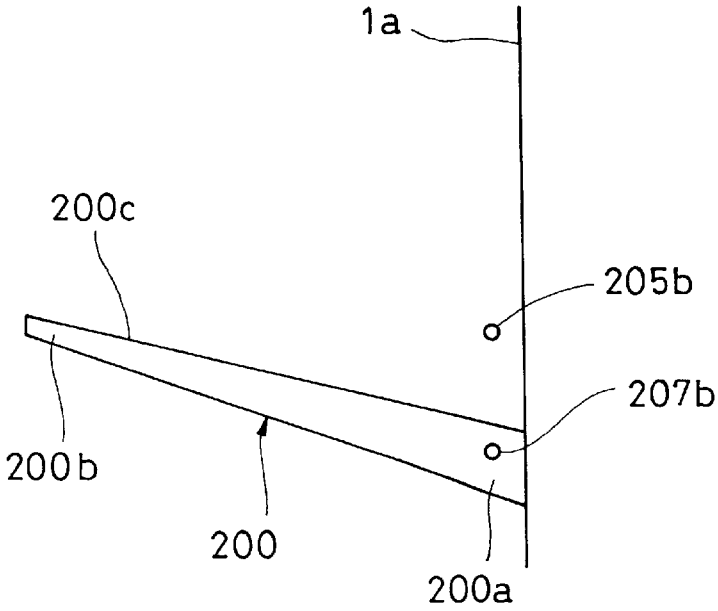
FIG. 23 a front elevational view of the sheet sensor and the stack tray.

As shown in FIG. 22, the first sheet sensor S205 is disposed in the sheet processing apparatus main body (see FIG. 1) as well as above the base end portion 200*a* of the stack tray 200 in the vicinity of the lower batch discharge roller 180*a*. The sheet sensor S205 includes a light emitting unit 205*a* and a light receiving unit 205*b* disposed above the stack tray 200 on the right and left sides thereof, respectively, and an optical axis (first optical axis) $L_1$ is formed therebetween. The aforesaid light emitting unit 205*a* and light receiving unit 205*b*are disposed so that the optical axis $L_1$ is made parallel with the trailing end edge of the sheets P when stacked and aligned on the stack tray 200. A second sheet sensor S207 is also a light transparent type sensor like the sheet sensor S205 and forms an optical axis $L_2$ between a light emitting unit 207*a* and a light receiving unit 207*b*. The light emitting unit 207*a* of the second sheet sensor S207 is disposed in the vicinity of the light emitting unit 205*a* of the first sheet sensor S205. The light emitting unit 207*a* and the light emitting unit 205*a* may be disposed so as to be adjacent to each other or arranged integrally as a common unit. The light receiving unit 207*b* of the second sheet sensor S207 is disposed slightly below the light receiving unit 205*b* of the first sheet sensor S205. That is, the optical axis $L_2$ of the second sheet sensor S207 is set such that it has a suitable angle with respect to the optical axis $L_1$ of the first sheet sensor S205, different from that the optical axis $L_1$ of the first sheet sensor S205 which is set in parallel with the trailing end edge of the sheets P on the stack tray 200. When the optical axes $L_1$, $L_2$ are blocked, the sheet sensors S205, S207 issue sensing signals. The sensing signals are input to the controller 930 which drives the motor 202 of the stack tray 200 to thereby lift or lower the stack tray 200 as described below. In the present invention, the first sheet sensor S205 is used when the optical axis $L_1$ is shaded by the sheets P stacked on the stack tray 200 in order to lower the stack tray 200 until the optical axis $L_1$ is restored, whereas the second sheet sensor S207 is used when, for example, the sheets P on the stack tray 200 is partly drawn out in a batch and the optical axis $L_2$ is restored in order to lift the stack tray 200 until the optical axis $L_2$ is shaded and thereafter to lower it until the optical axis $L_1$ is transmitted.

Further, since the optical axis $L_1$ is ordinarily in a transmitting state, when the sheets are placed on the stack tray 200 (when the sheets are drawn out once and placed again after the stack tray detect a sheet surface), the optical axis $L_1$ is blocked. Thus, the stack tray 200 is lowered until the optical axis $L_1$ is transmitted. With this arrangement, the sheet surface can be held in the vicinity of the optical axis $L_1$ at all times regardless of the sheets being drawn out or replaced.

Figure 24A:
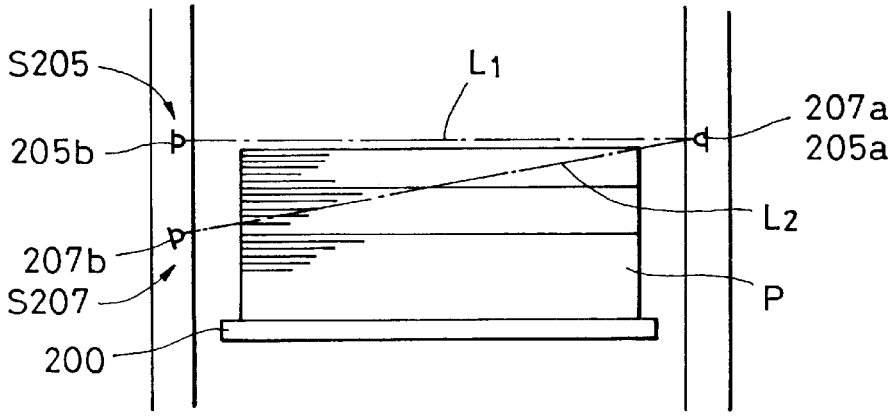
FIG. 24A, FIG. 24B and FIG. 24C are views describing an operation of a second sheet sensor and the stack tray.
Figure 24B:
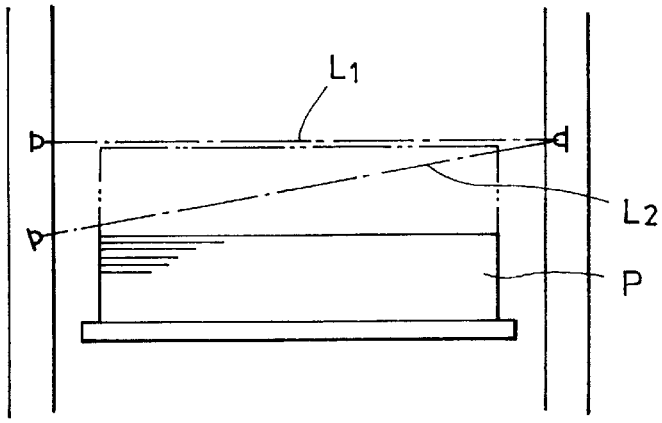
Figure 24C:
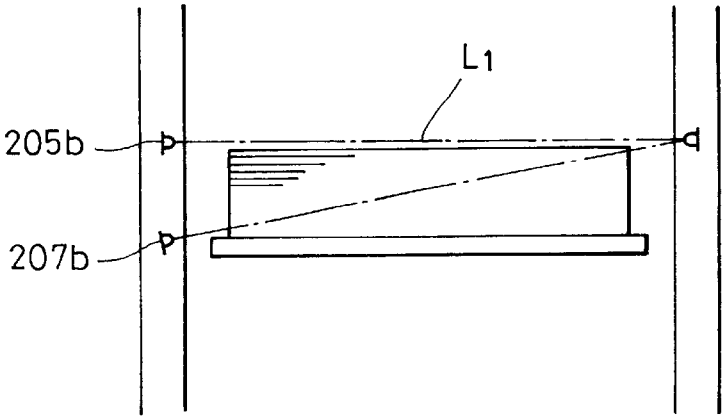

That is, it is assumed that the uppermost sheet of sheets P on the stack tray 200 is located at a proper position as shown in FIG. 24A and the sheets P are partly drawn out in a batch as shown in FIG. 24B. In this case, the drawn-out sheets cannot be sensed only by the first sheet sensor S205 and the upper surface of the uppermost sheet P remains lowered. When sheets P are continuously discharged in this state, since the sheets are dropped from a significant height, they are discharged and stacked badly. To cope with this problem, it is sensed by the second sheet sensor S207 that the sheet surface is lowered and further the stack tray 200 is lifted up to a proper position. As shown in FIG. 24C, the stack tray 200 is lifted until the optical axis $L_2$ of the second sheet sensor S207 is shaded. More specifically, after the stack tray 200 is lifted until the first sheet sensor S205 is shut off, it is lowered until the light emitted by the light emitting unit 205*a* is received by the light receiving unit 205*b*. With this arrangement, the position of the uppermost sheet P can be properly held at all times.

In the aforesaid embodiment, control is executed such that the optical axis $L_1$ is held in a state that it is not shaded by the sheets on the stack tray 200 and the upper surface of the sheets is located in the vicinity of the optical axis $L_1$ when the sheets P on the stack tray 200 is drawn out and the optical axis $L_2$ located below the optical axis $L_1$ is in a transmitting state. However, a similar effect can be also obtained by such an arrangement that the optical axis $L_1$ is held in a state shaded by the sheets on the stack tray 200, the optical axis $L_2$ detects that the sheet are placed on the stack tray 200 to thereby lower the stack tray 200 until the optical axis $L_1$ is transmitted and the stack tray 200 is lifted until the optical axis $L_1$ is transmitted when the sheets are removed because the optical axis $L_1$ is transmitted at the time.

In the above embodiment, the sheet sensors S205, S207 may be disposed at the following positions in addition to the above positions.

Figure 25A:
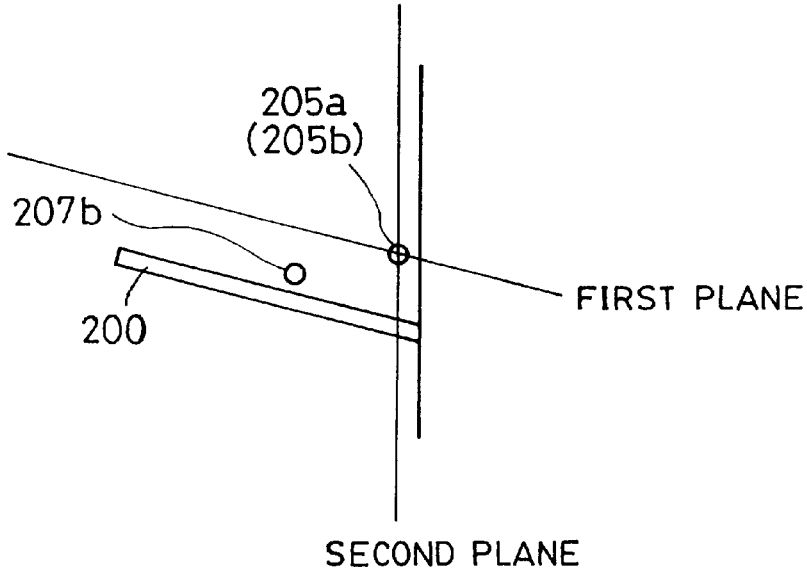
FIG. 25A and FIG. 25B are views showing a second embodiment and a third embodiment of the present invention, respectively.
Figure 25B:
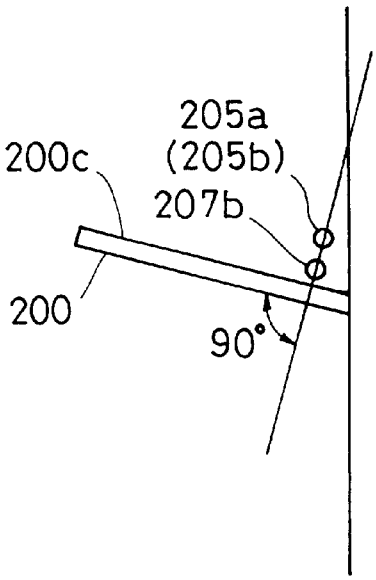

1) The light emitting unit 207*a* of the second sheet sensor S207 is disposed in the vicinity of the first sheet sensor S205 as well as the light receiving unit 207*b* of the second sheet sensor S207 is disposed within a range below a first plane, which passes through the first optical axis $L_1$, and is parallel with the sheets P on a sheet stacking surface 200*c*, as well as located on the base end side of the stack tray 200 with respect to a second vertical plane which passes through the first optical axis $L_1$ (FIG. 25A).

2) The light receiving unit 205*b* of the first sheet sensor S205 and the light receiving unit 207*b* of the second sheet sensor S207 are disposed side by side on a straight line which is approximately vertical to the sheet stacking surface 200*c*.

While the present invention has been described with respect to what is presently considered to be the preferred embodiments, it is to be understood that the invention is not limited to the disclosed embodiments. The present invention is intended to cover various modifications and equivalent arrangements included within the spirit and scope is the appended claims.

What is claimed is:

1. A sheet processing apparatus, comprising:

sheet stacking tray supported for upward and downward movement;

lifting/lowering means for lifting upward and lowering downward said sheet stacking tray;

first sensor means for sensing a position of an uppermost surface of a batch of sheets on said stacking tray and for moving said stacking tray in order that the position of said uppermost surface of a batch of sheets is lower than and does not reach to the detecting position of said first sensor means by control of said lifting/lowering means; and second sensor means for sensing that the batch of sheets on said sheet tray is partly drawn out and for moving said sheet stacking tray by control of said lifting/lowering means to thereby return said sheet stacking tray to a position proper to discharge sheets.

2. A sheet processing apparatus according to claim 1, wherein said first sensor means and said second sensor means are each a light transparent type sensor having a light emitting unit and a light receiving unit, the light emitting unit and the light receiving unit of said first sensor means forming an optical axis which is substantially parallel with a plane on which the batch of sheets is stacked and the light emitting unit and the light receiving unit of said second sensor means forming an optical axis which intersects the plane on which the batch of sheets is stacked.

3. A sheet processing apparatus according to claim 2, wherein said first and second sensor means sense a trailing end of the batch of sheets which has been discharged and stacked.

4. A sheet processing apparatus according to claim 2, wherein the light emitting units of said first and second sensor means are a single share unit.

5. A sheet processing apparatus according to claim 2, wherein the light receiving unit of said second sensor means is disposed approximately below the light receiving unit of said first sensor means in a direction substantially perpendicular to said first sensor means.

6. A sheet processing apparatus according to claim 2, wherein the light receiving unit of said second sheet sensor means is located within a range below a first plane, which passes through an optical axis of said first sensor means and is substantially parallel with a sheet stacking surface of said sheet stacking tray, and is located on the downward side in the sheet discharge direction of said sheet stacking tray with respect to a substantially vertical second plane which passes through the optical axis of said first sensor means.

7. A sheet processing apparatus according to claim 2, wherein said sheet stacking tray is inclined, a downstream side thereof in a sheet discharge direction being raise, and the light receiving unit of said second sensor means is disposed on a straight line which is substantially vertical to the sheet stacking surface of said sheet stacking tray.

8. A sheet processing apparatus according to any one of claims 5 to 7, wherein said first sensor means and said second sensor means each sense a trailing end of the batch of sheets which has been discharged and stacked.

9. A sheet processing apparatus according to any one of claims 5 to 7, wherein the light emitting units of said first sensor means and said second sensor means are a single shared unit.

10. A sheet processing apparatus according to any one of claims 5 to 7, wherein said sheet stacking tray is a first sheet stacking tray, and further comprising:

a second sheet stacking tray supported for upward and downward movement; and flapper means switched for introducing sheets to any of said first sheet stacking tray and said second sheet stacking tray.

11. A sheet processing apparatus according to any of claims 1 to claim 4, wherein said sheet stacking tray is a first sheet stacking tray, and further comprising:

a second sheet stacking tray supported for upward and downward movement; and flapper means switched for introducing sheets to any of said first sheet stacking tray and said second sheet stacking tray.

12. A sheet processing apparatus, comprising:

a sheet stacking tray supported for upward and downward movement;

lifting/lowering means for lifting upward and lowering downward said sheet stacking tray;

first sensor means for sensing a position of an uppermost surface of a batch of sheets on said stacking tray and for moving said sheet stacking tray in order that the position of said uppermost surface of a batch of sheets is lower than and does not reach the detecting position of said first sensor means by control of said lifting/lowering means; and second sensor means for sensing that the batch of sheets is placed on said sheet stack means and for moving said sheet stacking tray through said lifting/lowering means to thereby return said sheet stacking tray to a position proper to discharge sheets.

13. A sheet processing apparatus according to claim 12, wherein said first sensor means and said second sensor means are each a light transparent type sensor having a light emitting unit and a light receiving unit, the light emitting unit and the light receiving unit of said first sensor means forming an optical axis which is substantially parallel with a plane on which the batch of sheets is stacked and the light emitting unit and the light receiving unit of said second sensor means forming an optical axis which intersects the plane on which the batch of sheets is stacked.

14. A sheet processing apparatus according to claim 13, wherein said first and second sensor means sense the trailing end of the batch of sheets which has been discharged and stacked.

15. A sheet processing apparatus according to claim 13, wherein the light emitting units of said first and second sensor means are a single share unit.

16. A sheet processing apparatus according to any of claim 12 to claim 15, wherein said sheet stacking tray is a first sheet stacking tray, and further comprising:

a second sheet stacking tray supported for upward and downward movement; and flapper means for introducing sheets to any of said first sheet stacking tray and said second sheet stacking tray.

17. An image forming apparatus, comprising:

image forming means for forming an image on a sheet and discharging the sheet to a sheet processing apparatus, the sheet processing apparatus comprising:

a sheet stacking tray supported for an upward and downward movement;

lifting/lowering means for lifting upward and lowering downward said sheet stacking tray;

first sensor means for sensing a position of an uppermost surface of a batch of sheets on said stacking tray and for moving said stacking tray in order that the position of said uppermost surface of a batch of sheets is lower than and does not reach to the detecting position of said first sensor means by control of said lifting/lowering means; and second sensor means for sensing that the batch of sheets on said sheet tray is partly drawn out and for moving said sheet stacking tray by control of said lifting/lowering means to thereby return said sheet stacking tray to a position proper to discharge sheets.

18. An image forming apparatus according to claim 17, wherein said first sensor means and said second sensor means are each a light transparent type sensor having a light emitting unit and a light receiving unit, the light emitting unit and the light receiving unit of said first sensor means forming an optical axis which is substantially parallel with a plane on which the batch of sheets is stacked and the light emitting unit and the light receiving unit of said second sensor means forming an optical axis which intersects the plane on which the batch of sheets is stacked.

19. An image forming apparatus according to claim 17, wherein said first and second sensor means sense the trailing end of the batch of sheets which has been discharged and stacked.

20. An image forming apparatus according to claim 17, wherein the light emitting units of said first and second sensor means are a single shared unit.

21. An image forming apparatus according to any of claim 17 to claim 20, wherein said sheet stacking tray is a first sheet stacking tray, and further comprising:

a second sheet stacking tray supported for upward and downward movement; and flapper means for introducing sheets to any of said first sheet stacking tray and said second sheet stacking tray.

22. An image forming apparatus, comprising:

image forming means for forming an image on a sheet and discharging the sheet to a sheet processing apparatus, the sheet processing apparatus comprising:

a sheet stacking tray supported for upward and downward movement;

lifting/lowering means for lifting the upward and lowering downward said sheet stacking tray;

first sensor means for sensing a position of an uppermost surface of a batch of sheets on said stacking tray and for moving said stacking tray in order that the position of said uppermost surface of a batch of sheets is lower than and does not reach to the detecting position of said first sensor means by control of said lifting/lowering means; and second sensor means for sensing that the batch of sheets on said sheet tray is partly drawn out and for moving said sheet stacking tray by control of said lifting/lowering means to thereby return said sheet stacking tray to a position proper to discharge sheets;

wherein said first sensor means and said second sensor means are each a light transparent type sensor having a light emitting unit and light receiving unit; and wherein the light receiving unit of said second sensor means is disposed approximately below the light receiving unit of said first sensor means in a direction substantially perpendicular to said first sensor.

23. An image forming apparatus according to claim 22, wherein the light receiving unit of said second sheet sensor means is located within a range below a first plane, which passes through an optical axis of said first sensor means and is substantially parallel with a sheet stacking surface of said sheet stacking tray, and is located on the downward side in the sheet discharge direction of said sheet stacking tray with respect to a substantially vertical second plane which passes through the optical axis of said first sensor means.

24. An image forming apparatus according to claim 22, wherein said sheet stacking tray is inclined, a downstream side thereof in a sheet discharge direction being raise, and the light receiving unit of said second sensor means is disposed on a straight line which is substantially vertical to the sheet stacking surface of said sheet stacking tray.

25. An image forming apparatus, comprising:

image forming means for forming an image on a sheet and discharging the sheet to a sheet processing apparatus, the sheet processing apparatus comprising:

a sheet stacking tray supported for upward and downward movement;

lifting/lowering means for lifting upward and lowering downward said sheet stacking tray;

first sensor means for sensing a position of an uppermost surface of a batch of sheets on said stacking tray and for moving said sheet stacking tray in order that the position of said uppermost surface of a batch of sheets is lower than and does not reach to the detecting position of said first sensor means by control of said lifting/lowering means; and second sensor means forming an optical axis which intersects a plane on which the batch of sheets is stacked for sensing that the batch of sheets is placed on said sheet stack means for moving said sheet stacking tray by control of said lifting/lowering means to thereby return said sheet stacking tray to a position proper to discharge sheets.

26. An image forming apparatus according to claim 25, wherein said first sensor means and said second sensor means are each a light transparent type sensor having a light emitting unit and a light receiving unit, the light emitting unit and the light receiving unit of said first sensor means forming an optical axis which is substantially parallel with a plane on which the batch of sheets is stacked and the light emitting unit and the light receiving unit of said second sensor means forming an optical axis which intersects the plane on which the batch of sheets is stacked.

27. An image forming apparatus according to claim 25, wherein said first and second sensor means sense the trailing end of the batch of sheets which has been discharged and stacked.

28. An image forming apparatus according to claim 26, wherein the light emitting units of said first and second sensor means are a single shared unit.

29. An image forming apparatus according to any of claim 25 to claim 28, wherein said sheet stacking tray is a first sheet stacking tray, and further comprising:

a second sheet stacking tray supported for upward and downward movement;

flapper means for introducing sheets to any of said first sheet stacking tray and said second sheet stacking tray.

* * * * *

UNITED STATES PATENT AND TRADEMARK OFFICE

CERTIFICATE OF CORRECTION

PATENT NO. : 6,237,910 B1
DATED : May 29, 2001
INVENTOR(S) : Wataru Kawata

It is certified that error appears in the above-identified patent and that said Letters Patent is hereby corrected as shown below:

Column 2,
Line 8, "ray should read -- tray --.

Column 3,
Line 24, "a" should read -- is a --.
Line 37, "<EMBODIMENT>" should read -- EMBODIMENT 1 --.

Column 7,
Line 67, "are" should read -- is --.

Column 8,
Line 4, "close" should read -- closed --.
Line 5, "close" should read -- closed --.
Line 59, "located" should be deleted.

Column 9,
Line 24, "integrally" should read -- integrally with --.
Line 45, "sensor 203b" should read -- sensor S203b --.

Column 11,
Line 14, "forth" should read -- fourth --.
Line 58, "documents>number" should read -- documents≥number --.
Line 59, "batch<20 sheets" should read -- batch≤20 sheets --.

Column 12,
Line 27, "sensor S2031')." should read -- sensor S203'). --.
Line 59, "unit 205bare" should read -- unit 205b are --.

Column 14,
Line 23, "sheet" should read -- a sheet --.
Line 56, "share" should read -- shared --.

Column 15,
Line 5, "raise," should read -- raised, --.
Line 47, "stack" should read -- stacking --.
Line 67, "share" should read -- shared --.

UNITED STATES PATENT AND TRADEMARK OFFICE

CERTIFICATE OF CORRECTION

PATENT NO. : 6,237,910 B1
DATED : May 29, 2001
INVENTOR(S) : Wataru Kawata

It is certified that error appears in the above-identified patent and that said Letters Patent is hereby corrected as shown below:

Column 16,
Line 59, "the" should be deleted.

Column 17,
Line 24, "raise," should read -- raised, --.

Column 18,
Line 8, "stack means" should read -- stacking tray --.
Line 34, "movement;" should read -- movement; and --.

Signed and Sealed this

Fourth Day of December, 2001

*Attest:*

Nicholas P. Godici

*Attesting Officer*

NICHOLAS P. GODICI
*Acting Director of the United States Patent and Trademark Office*